US006322569B1

(12) United States Patent
Sueyoshi et al.

(10) Patent No.: US 6,322,569 B1
(45) Date of Patent: Nov. 27, 2001

(54) EPILATING DEVICE

(75) Inventors: Hidekazu Sueyoshi, Kanzaki-gun; Jyuzaemon Iwasaki, Nagahama; Tomoyuki Inoue, Hikone, all of (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/556,683

(22) Filed: Apr. 21, 2000

(30) Foreign Application Priority Data

Apr. 23, 1999 (JP) ..... 11-115704

(51) Int. Cl.[7] ..... A45D 26/00
(52) U.S. Cl. ..... 606/133
(58) Field of Search ..... 606/133, 131

(56) References Cited

U.S. PATENT DOCUMENTS 4,575,902 * 3/1986 Alazet ..... 19/2
4,960,422 * 10/1990 Demeester ..... 606/135
5,494,485 * 2/1996 Gabion et al. ..... 606/133
5,611,804 * 3/1997 Heintke et al. ..... 606/133
5,797,925 * 8/1998 Heintke ..... 606/133
5,857,903 * 1/1999 Ramspeak et al. ..... 606/133
6,045,559 * 4/2000 Sueyoshi et al. ..... 606/133
6,074,400 * 6/2000 Nuijs et al. ..... 606/133
6,123,713 * 9/2000 Yiu et al. ..... 606/133
6,176,862 * 1/2001 Delax et al. ..... 606/133

* cited by examiner

*Primary Examiner*—Paul J. Hirsch
(74) *Attorney, Agent, or Firm*—Oblon, Spivak, McClelland, Maier & Neustadt, P.C.

(57) ABSTRACT

An epilating device including a plurality of blades, a blade moving member, and an actuator. The plurality of blades are configured to pluck hairs and includes at least one movable blade which is configured to oscillate to grip and release the hairs. The blade moving member is configured to be reciprocally and linearly moved to oscillate the at least one movable blade. The actuator is configured to move the blade moving member reciprocally and linearly without contacting the blade moving member.

28 Claims, 20 Drawing Sheets

EPILATING DEVICE

CROSS-REFERENCE TO RELATED APPLICATIONS

The present application claims priority under 35 U.S.C. § 119 to Japanese Patent Application No. Hei11-115704, filed Apr. 23, 1999, entitled "Epilating Device." The contents of that application are incorporated herein by reference in their entirety.

BACKGROUND OF THE INVENTION

1. Field of the Invention

The present invention relates to an epilating device to remove hairs for, for example, beauty or cosmetic purposes.

2. Description of the Background

Epilating devices are disclosed in Japanese Patent 2736797 (corresponding U.S. Pat. No. 4,960,422), entitled "Depilating Appliance"; and Japanese Examined Patent Application (kokoku) Hei7-79731(corresponding U.S. Pat. No. 4,575,902), entitled "Depilating Appliance." The contents of these references are incorporated herein by reference in their entirety.

The U.S. Pat. No. 4,960,422 discloses an epilating device having a plucking head for plucking hairs by swinging and then moving blades. The U.S. Pat. No. 4,575,902 discloses an epilating device wherein plucking blades are opened/closed by utilizing projections provided on the plucking blades. Further, the U.S. Pat. No. 4,575,902 discloses that the means for closing the plucking blades may be an electromagnet.

Specifically, according to the U.S. Pat. No. 4,960,422, a bar is pushed by a wheel and epilating blades engaged with the bar are closed and pluck body hairs, thereby obtaining stable strength for holding the body hairs between the blades and ensuring plucking the hairs. According to the U.S. Pat. No. 4,575,902, body hairs are plucked by elastically deforming an epilating disk by the electromagnet, thereby making it possible to reduce driving noise generated when the disk is opened/closed.

SUMMARY OF THE INVENTION

According to one aspect of the present invention, an epilating device includes a plurality of blades, a blade moving member, and an actuator. The plurality of blades are configured to pluck hairs and includes at least one movable blade which is configured to oscillate to grip and release the hairs. The blade moving member is configured to be reciprocally and linearly moved to oscillate the at least one movable blade. The actuator is configured to move the blade moving member reciprocally and linearly without contacting the blade moving member.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 11(*b*) is an explanatory view for indicating the directions of the magnetic fluxes of the magnet provided on the base;

DESCRIPTION OF THE PREFERRED EMBODIMENTS

Figure 1:
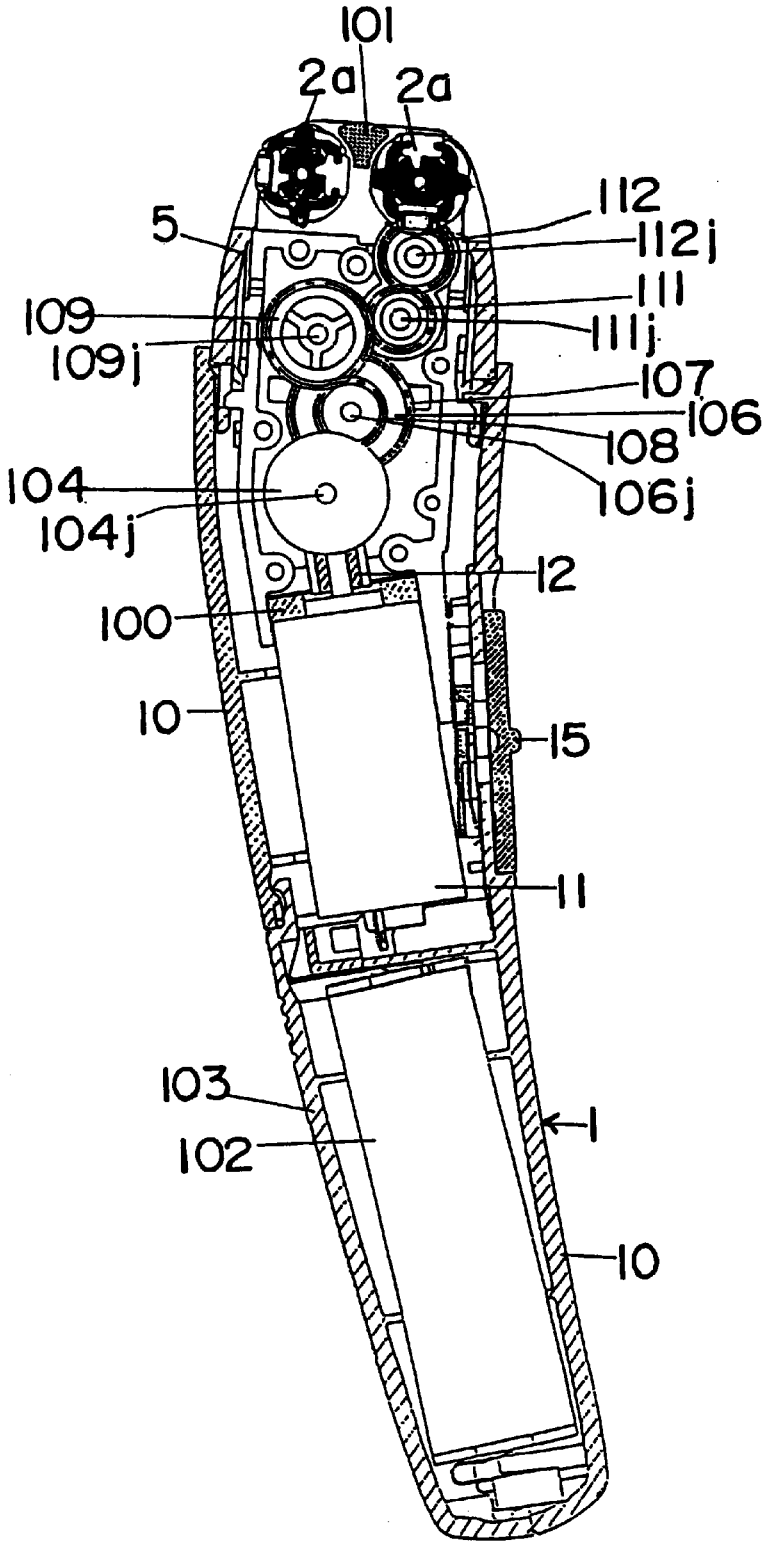
FIG. 1 is a side sectional view according to the present invention.

The preferred embodiments will now be described with reference to the accompanying drawings, wherein like reference numerals designate corresponding or identical elements throughout the various drawings.

Referring now FIGS. 1 to 15, there is shown an epilating device for removal of body hairs in accordance with a preferred embodiment of the present invention.

As shown in FIGS. 1 to 6, the epilating device includes at least one plucking head (2*a*). For example, the epilating device includes two plucking heads. A main body block 1 includes a housing 10 which has front and back divided sections. The housing 10 contains a motor 11 which is fixed to bases (55L) and (55R) which are provided in the housing 10. A head frame 5 having an opening on its upper end is removably mounted on the upper end of the housing 10. A leg piece (5*a*) having a hole (5*b*) extends from a part of a lower portion of the head frame 5. The hole (5*b*) provided in the leg piece (5*a*) of the head frame 5 is engaged with ribs 551 provided on the base (55R), thereby attaching the leg piece (5*a*) to the base (55R). The motor 11 is fixed to a motor fixing plate 100 via screws to be positioned between the bases (55L) and (55R). Projecting pieces (100*a*) which are provided on both sides of the motor fixing plate 100 are fitted into fitting recesses (55*i*) which are provided on inner surfaces of the two bases (55L) and (55R), respectively. Battery cells 102 serving as a drive source are provided in a lower end portion of the housing 10 and covered by a battery cover 103. A blade moving 15 is provided on an outer surface of the housing 10. The housing 10 serves as a grip section which is adapted to be held by hand.

Figure 2:
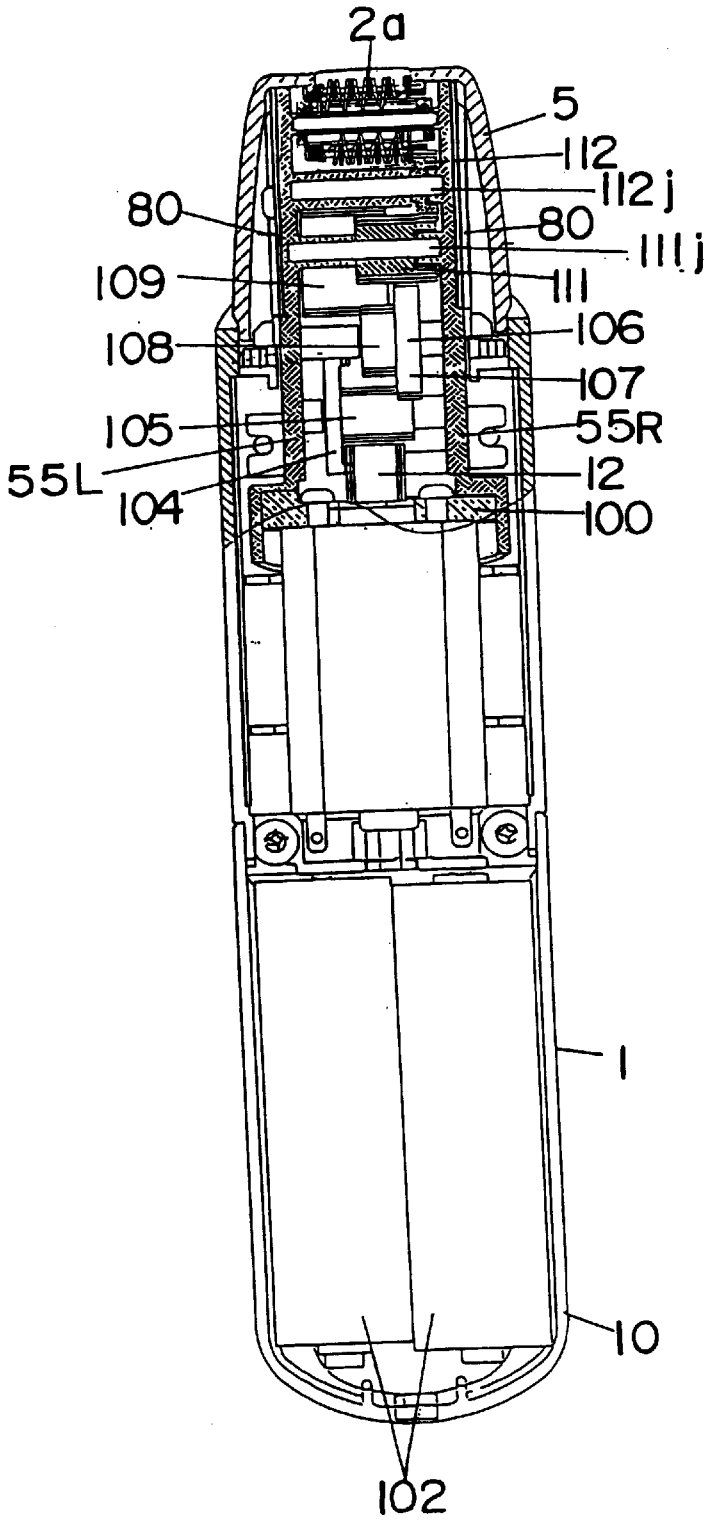
FIG. 2 is a front sectional view according to the present invention.
Figure 6:
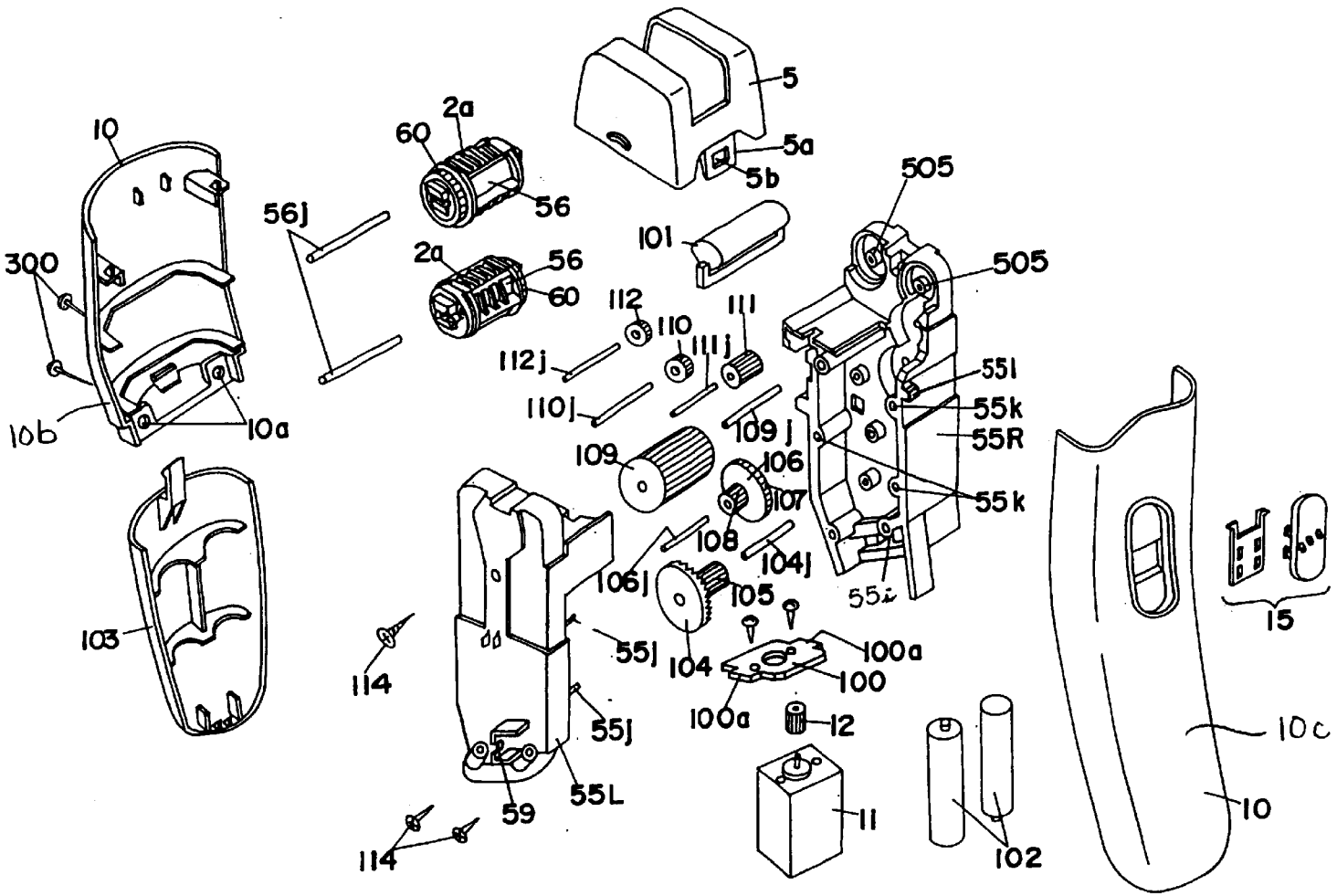
FIG. 6 is an exploded perspective view of an entire main body block according to the present invention.

A pinion 12 is press-fitted and fixed to an output shaft of the motor 11 which is provided in a space between the bases (55L) and (55R) through the motor fixing plate 100. In addition, a face gear 104 is rotatably attached to the bases (55L) and (55R) via a shaft (104*j*) as shown in FIGS. 1, 2 and 6. The face gear 104 is meshed with the pinion 12 to thereby transmit the rotation of the pinion 12 to the face gear 104. A small gear 105 is provided integrally with the face gear 104. This small gear 105 is meshed with a large gear 107 of an intermediate gear 106 rotatably attached to the bases (55L) and (55R) via a shaft (106*j*), thereby transmitting the rotation of the pinion 12 to the intermediate gear 106. The intermediate gear 106 is provided with a small gear 108 which is meshed with a drive gear 109 which is rotatably provided on the bases (55L) and (55R) via a shaft (109*j*).

Furthermore, a gear 110 is rotatably attached to the bases (55L) and (55R) via a shaft (110*j*). The gear 110 is provided to be shifted toward the base (55L) along a longitudinal direction of the shaft (110*j*). Gears 111 and 112 are also rotatably attached to the bases (55L) and (55R) via shafts (111*j*) and (112*j*). The gears 111 and 112 are provided to be shifted toward the base (55R) along a longitudinal direction of the shafts (111*j*) and (112*j*). Both the gears 110 and 111 are meshed with the drive gear 109, and the gear 111 is meshed with the gear 112. Therefore, the rotation of the motor 11 is transmitted to the gears 110 and 112 through a series of gears.

As stated above, the motor 11 and the series of gears are provided between the bases (55L) and (55R). Bosses (55*j*) which are provided on the base (55L) are fitted into recesses (55*k*) which are provided on the base (55R), respectively. The base (55L) is fixed to the base (55R) by screws 114. Further, in order to fix the bases (55L) and (55R), screws 300 pass through holes (10*a*) of the back divided section (10*b*) of the housing 10 and ribs 59 provided on the bases (55L) and (55R), and are screwed to the front divided section (10*c*) of the housing 10.

Figure 7:
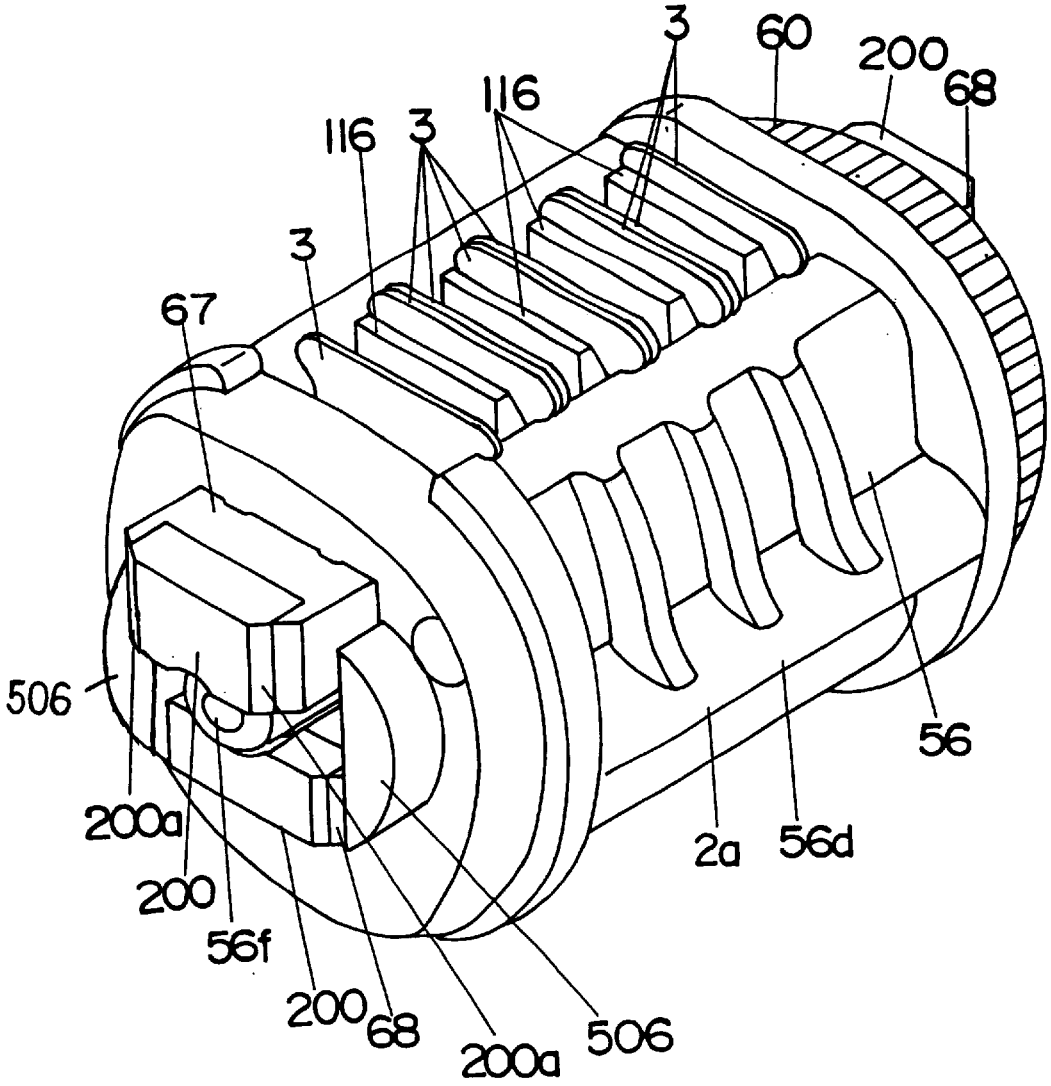
FIG. 7 is a perspective view of a plucking head used in the present invention.
Figure 9:
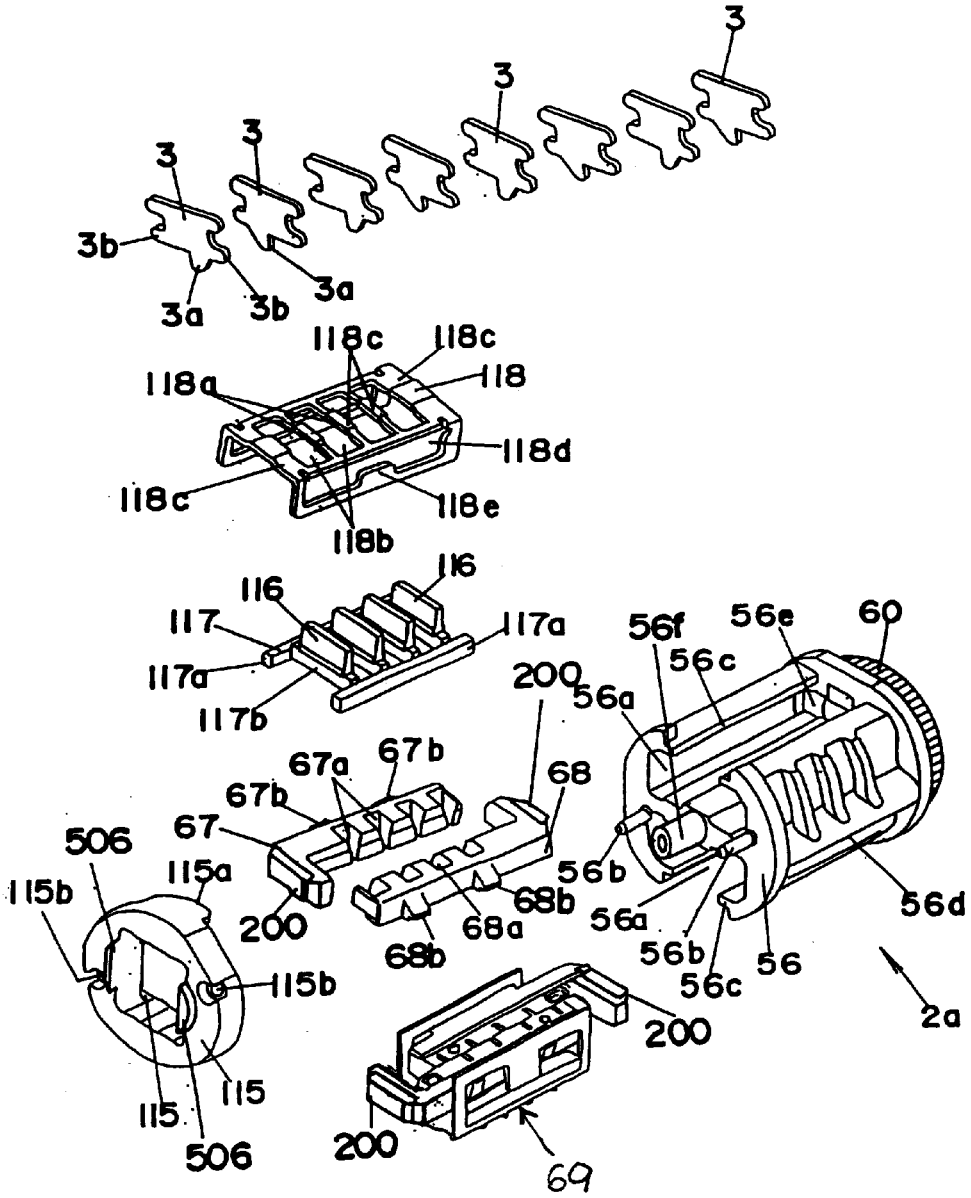
FIG. 9 is an exploded perspective view of an entire plucking head according to the present invention.

As shown in FIGS. 2, 7 and 9, each of two plucking heads (2*a*) includes at least one blade block body 69, a blade attachment base 56 and a cover 115. In these Figures, the plucking head (2*a*) includes, for example, two blade block bodies 69. The blade block bodies 69 are arranged in the blade attachment base 56 in substantially parallel with a rotary shaft (56*j*) of the plucking head (2*a*) and symmetrically with respect to the center axis of the rotary shaft (56*j*). A blade attachment base gear 60 is formed on one longitudinal end of the blade attachment base 56. The blade attachment base gear 60 meshes with either the gear 110 or 120 to rotate the plucking head (2*a*) The cover 115 is provided at the other longitudinal end of the blade attachment base 56. The cover 115 prevents the blade block bodies 69 from detaching from the blade attachment base 56.

The two plucking heads (2*a*) are attached on the upper portion of the main body block 1 so as to be parallel to the rotary shaft (56*j*) each other. Each of the blade attachment gears 60 of the two plucking heads (2*a*) is provided on the opposite side on the upper portion of the main body block 1. Thus one of the blade attachment gears 60 is meshed with the gear 110 and the other blade attachment gear 60 is meshed with the gear 112.

The plucking heads (2*a*) are driven as follows. When the face gear 104 attached to the shaft (104*j*) rotates following the rotation of the motor 11, the rotation of the intermediate gear 106 attached to the shaft (106*j*) is transmitted the rotation by the small gear 105. Further, the blade attachment base gear 60 of the plucking heads (2*a*) is rotated through the drive gear 109 attached to the shaft (109*j*) and the gear 110 attached to the shaft (110*j*), thereby rotating one of the plucking heads (2*a*). The blade attachment base gear 60 of the other plucking head (2*a*) is provided on the side facing the base (55L), while the blade attachment base gear 60 of the one plucking head (2*a*) is provided on the side facing the base (55R). The blade attachment base gear 60 of the other plucking head (2*a*) is rotated through the gear 109 attached to the shaft (109*j*), the gear 111 attached to the shaft (111*j*) and the gear 112 attached to the shaft (112*j*), thereby rotating the other plucking head (2*a*). The number of gears for rotating one head (2*a*) is set to be odd (the drive gear 110) and the number of gears for rotating the other plucking head (2*a*) is set to be even (because of one additional gear 111 or 112). Accordingly, the two plucking heads (2*a*) may be rotated in opposite directions.

Figure 10:
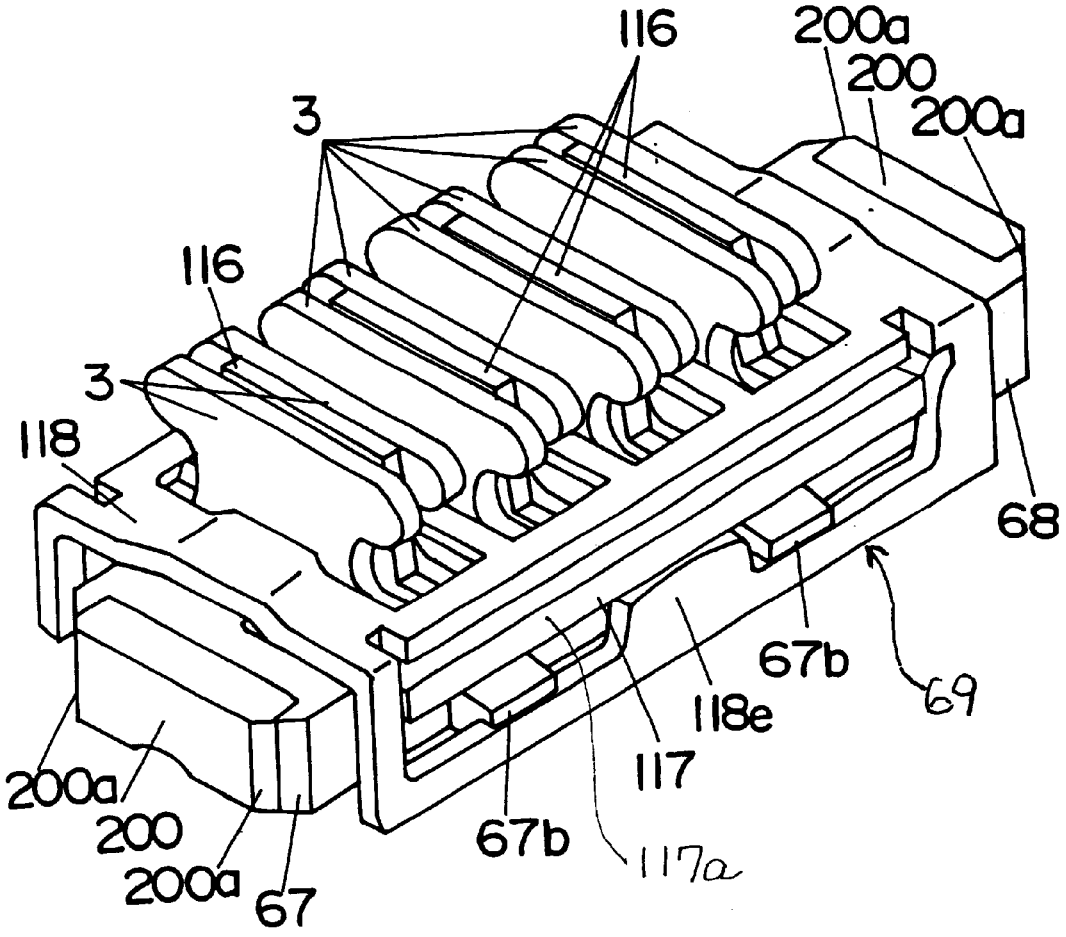
FIG. 10 is a perspective view of a blade block body according to the present invention.
Figure 13:
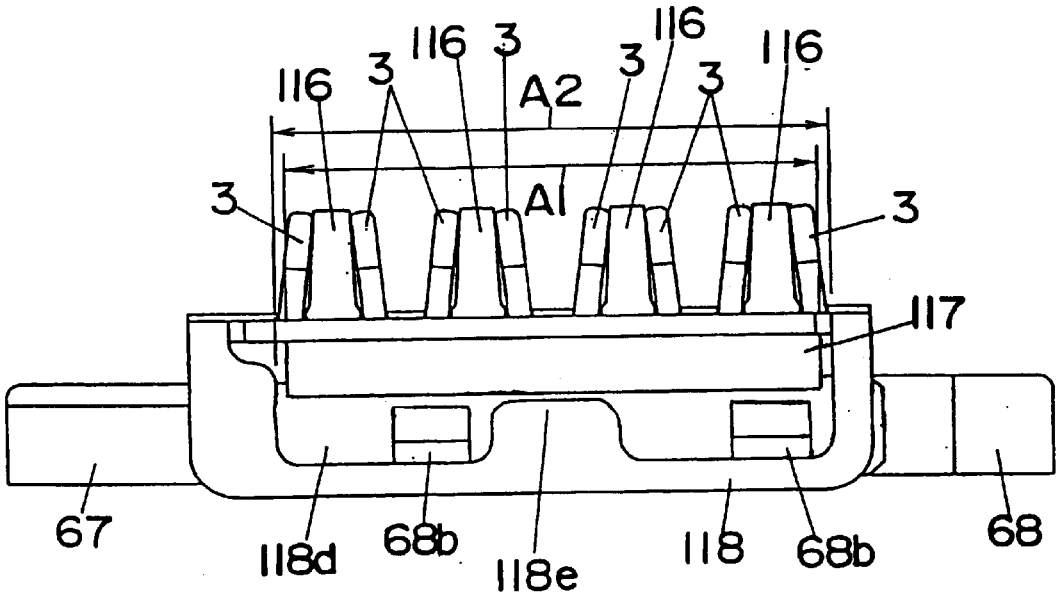
FIG. 13 is a front view showing a state in which the blade block body is assembled according to the present invention.

As shown in FIGS. 9, 10 and 13, the blade block body 69 includes of a fixed blade block 117 on which at least one fixed blade 116 is disposed, a blade fulcrum member 118 on which fulcrum sections (118*a*) are provided, at least one movable blade 3, and a pair of blade moving levers 67 and 68 for oscillating the movable blade 3 along an axial direction of the rotary shaft of the blade block body 69. In this embodiment, a plurality of fixed blades 116 and movable blades 3 are provided. A plucking blade includes the movable blades 3 and the fixed blades 116. The movable blades 3 are configured to oscillate to grip hairs between the movable blades 3 and the fixed blades 116 and to release the hairs. The movable blades 3 may grip hairs between the movable blades 3 without providing fixed blades. In this embodiment, the movable blades 3 are arranged to be swingable to grip and release hairs. Namely, the movable blades 3 may repeatedly swing or pivot.

The fixed blade block 117 is constituted by integrally arranging the fixed blades 116 between a pair of beams (117*a*) at constant intervals. Both sides of the lower portions of the fixed blades 116 serve as fulcrum sections (117*b*).

As shown in FIGS. 9 and 10, the blade fulcrum member 118 is of U-shape with side pieces extending from both sides of an upper surface piece. A plurality of rectangular openings (118*b*) are formed at constant intervals in the longitudinal direction of the blade fulcrum member 118. The longitudinal central portions of both the beams (118*c*) between the openings (118*b*) and the beams (118*c*) on the both longitudinal end portions of the blade fulcrum member 118 protrude upward in FIGS. 9 and 10 (i.e., in the opposite direction to the protruding direction of the side pieces of the blade fulcrum member 118). Both sides of the protruding portions at the longitudinal central portions of the beams (118*c*) (or inside in case of the beams (118*c*) on both of the end portions of the blade fulcrum member 118) serve as fulcrum sections (118*a*) The beams (118*c*) and the openings (118*b*) are not arranged symmetrically in the longitudinal direction of the blade fulcrum member 118 but arranged to be deviated to either side. Thus, in this embodiment, the width of the beam (118*c*) on one of the longitudinal end portions of the blade fulcrum member 118 is formed to be larger than that of the beam (118*c*) on the other longitudinal end portion thereof.

Holes (118*d*) are provided in a symmetric manner in both of the side pieces of the blade fulcrum member 118. The central portions of the holes (118*d*) become ribs (118*e*) protruding upwardly from the lower ends of the holes (118*d*), respectively. The fixed blade block 117 on which a plurality of the fixed blades 116 are arranged is assembled such that the fixed blades 116 and the beams (118*c*) are alternately fitted into the rectangular openings (118*b*) of the blade fulcrum member 118 as shown in FIG. 10. To prevent the detachment of the fixed blade block 117, the ribs (118*e*) provided in a symmetrical manner on both of side surfaces of the blade fulcrum member 118 abut against lower surfaces of the beams (117*a*) of the fixed blade block 117 and side walls of the holes (118*d*) abut against longitudinal end portions of the beams (117*a*). Here, as shown in FIG. 13, the length (A2) of the longitudinal direction of the holes (118*d*) is set slightly larger than the length (A1) of the beam (117*a*) of the fixed blade block 117. Small gaps are, therefore, formed between the longitudinal end portion of the beam (117*a*) and the side wall of the holes (118*d*), respectively, in the longitudinal direction of the blade fulcrum member 118. Therefore, the fixed blade block 117 can be slightly shaky with respect to the blade fulcrum member 118.

Each of the movable blades 3 has a protruding piece (3*a*) shifted to one side in the lower end thereof and protruding pieces (3*b*) are also provided on both sides of the lower portion of the blade 3, respectively.

Slit grooves (67*a*) are formed at certain intervals on one longitudinal side portion of the blade moving lever 67, hooks (67*b*) are formed at certain intervals on the other longitudinal side portion of the lever 67, and a permanent magnet 200 is provided integrally with the lever 67 on the one longitudinal end portion of the lever 67. Likewise, slit grooves (68*a*) are formed at certain intervals on one longitudinal side portion of the blade moving lever 68, hooks (68*b*) are formed at certain intervals on the other longitudinal side portion of the lever 68, and a permanent magnet 200 is provided integrally with the lever 68 on the one longitudinal end portion of the lever 68. The blade moving levers 67 and 68 are arranged each other so that the side surface portion on which the slit grooves (67*a*) are provided faces the side surface portion on which the slit grooves (68*a*) are provided. In this state, the hooks (67*b*) and (68*b*) of the levers 67 and 68 are slidably fitted into the holes (118*d*), respectively and the blade moving levers 67 and 68 are thereby incorporated into the blade fulcrum member 118. Therefore, the hooks (67*b*) and (68*b*) may slides in the holes (118*d*) between the side wall and the rib (118*e*) on the lower end of the hole (118*d*). The blade moving levers 67 and 68 are configured to be reciprocally and substantially linearly moved to oscillate the movable blades 3.

The protruding portions (3*a*) of the movable blades 3 are swingably fitted into the slit grooves (67*a*) of the blade moving lever 67 and the slit grooves (68*b*) of the blade moving lever 68, respectively. As shown in FIG. 9, the movable blades 3 are arranged such that the protruding portions (3*a*) positioned to be deviated toward the front side of FIG. 9 and those positioned to be deviated toward the back side of FIG. 9 are alternately provided. Then, protruding portions (3*a*), which are deviated toward the front side, are swingably fitted into the blade moving lever 68, and protruding portions (3*a*), which portions are deviated toward the back side, are swingably fitted into the blade moving lever 67.

Here, the blade moving levers 67 and 68 are incorporated so that the magnet 200 provided on one end of the blade moving lever 67 protrudes outward from one end of the blade fulcrum member 118, the magnet 200 provided on one end of the blade moving lever 68 protrudes outward from the other end of the blade fulcrum member 118. Furthermore, a length from the magnet 200 of the blade moving lever 67 to one end of the blade fulcrum member 118 is equal to a length from the magnet 200 of the blade moving lever 68 to the other end of the blade fulcrum member 118. Namely, if the plucking head (2*a*) constituted by incorporating the blade block body 69 into the blade attachment base 56 is attached to the upper portion of the main body block 1 by the rotary shaft (56*j*) as will be described later, the blade moving levers 67 and 68 are incorporated into the main body block 1 so that lengths from magnets 201 having the same polarity as that of the magnets 200 provided on the blade moving levers 67 and 68 arranged at the left and right sides of the upper opening of the main body block 1 for driving the blade moving levers 67 and 68, to the both longitudinal ends of the blade fulcrum member 118 are equal, as will be described later.

As stated above, the movable blades 3 are incorporated into the slit grooves (67*a*) and (68*a*) of the blade moving levers 67 and 68, respectively so that the protruding portions (3*a*) are freely swingable. In that case, each of the movable blades 3 fitted into the slit grooves (67*a*) and (68*a*) are arranged so that the fixed blade 116 is positioned between the movable blade 3 fitted into the slit groove (67*a*) and the movable blade 3 fitted into the slit groove (68*a*). Additionally, each of the fulcrum sections of the blade fulcrum member 118 is positioned between the movable blades 3 fitted into the slit grooves (67*a*) and (68*a*) between the fixed blades 116. Each movable blade 3 swings with respect to the fulcrum sections (117*b*) and (118*a*) provided at the fixed blade block 117 and the blade fulcrum member 118,respectively. The fulcrum sections (117*b*) and (118*a*) function as fulcrums. The two movable blades 3 are arranged between the fixed blades 116 and incorporated into the slit grooves (67*a*) and (68*a*), respectively, thereby constituting a series of plucking blades.

Figure 20:
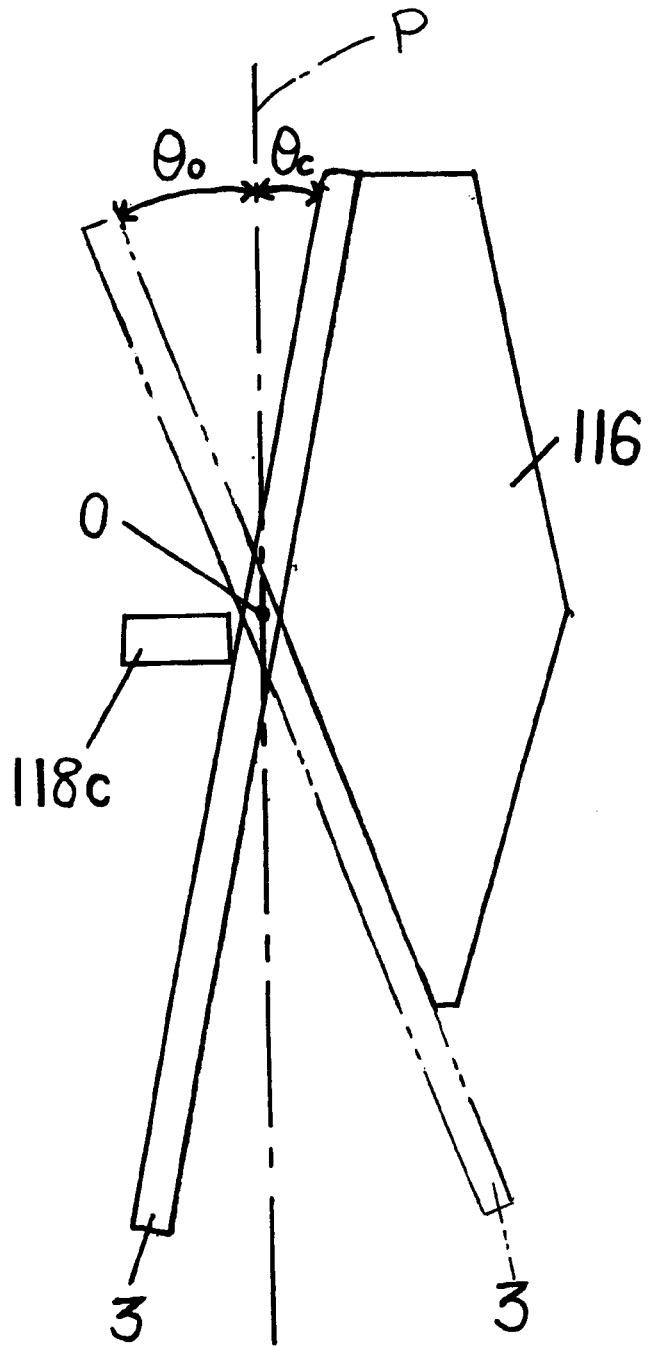
FIG. 20 is a schematic view illustrating opening and closing angles.

The blade block body 69 is assembled as stated above and constituted such that blade moving means of the movable blades 3 and the hair grip section serve as one block member. In addition, two movable blades 3 are arranged between the fixed blades 116 and fulcrums applied with forces particularly while the movable blades 3 are closed at the swinging fulcrums thereof, are formed on the blade fulcrum member 118 separate from the fixed blade block 117. Accordingly, it is possible to thin the swinging fulcrums by making the blade fulcrum member 118 preferably from hard material such as a sheet metal. As a result, the pitch between the fixed blade block 117 and the movable blade 3 can be reduced and the longitudinal width of the blade fulcrum member 118 can be reduced. It is, therefore, possible to provide a small-sized plucking head capable of closely attaching to even a small area such as an armpit. Also, it is possible to improve hair plucking efficiency for plucking even short hairs since the longitudinal width of the blade block body 69 can be reduced. In this case, the length between the fixed blade 116 of the fixed blade block 117 and the movable blade 3 is set smaller than the length between the beam (118*c*) provided between the movable blades 3 and the movable blade 3. Accordingly, referring to FIG. 20, a closing angle ($\theta c$) formed between the movable blade 3 and a plane (P) which is in parallel with the at least one fixed blade 116 and which passes the swinging center (O) when the movable blade 3 is in the closing position as shown by a solid line is smaller than an opening angle (θ*o*) formed between the movable blade 3 and the plane (P) when the at least one movable blade is in the opening position as shown by a phantom line. Therefore, good hair plucking with less chances of breaking hairs while holding the hairs can be ensured.

Figure 14:
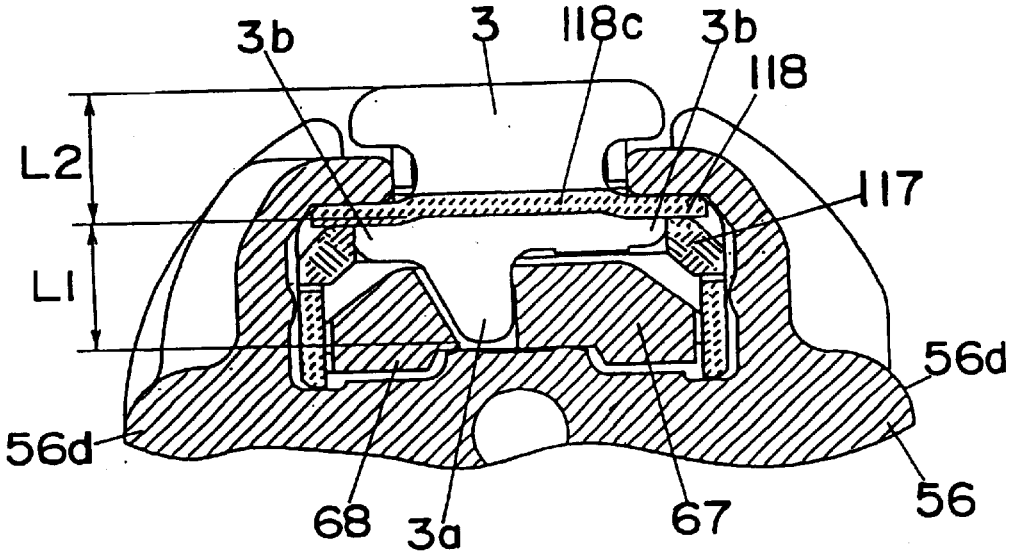
FIG. 14 is a side sectional view of the important parts of the plucking head according to the present invention.
Figure 15:
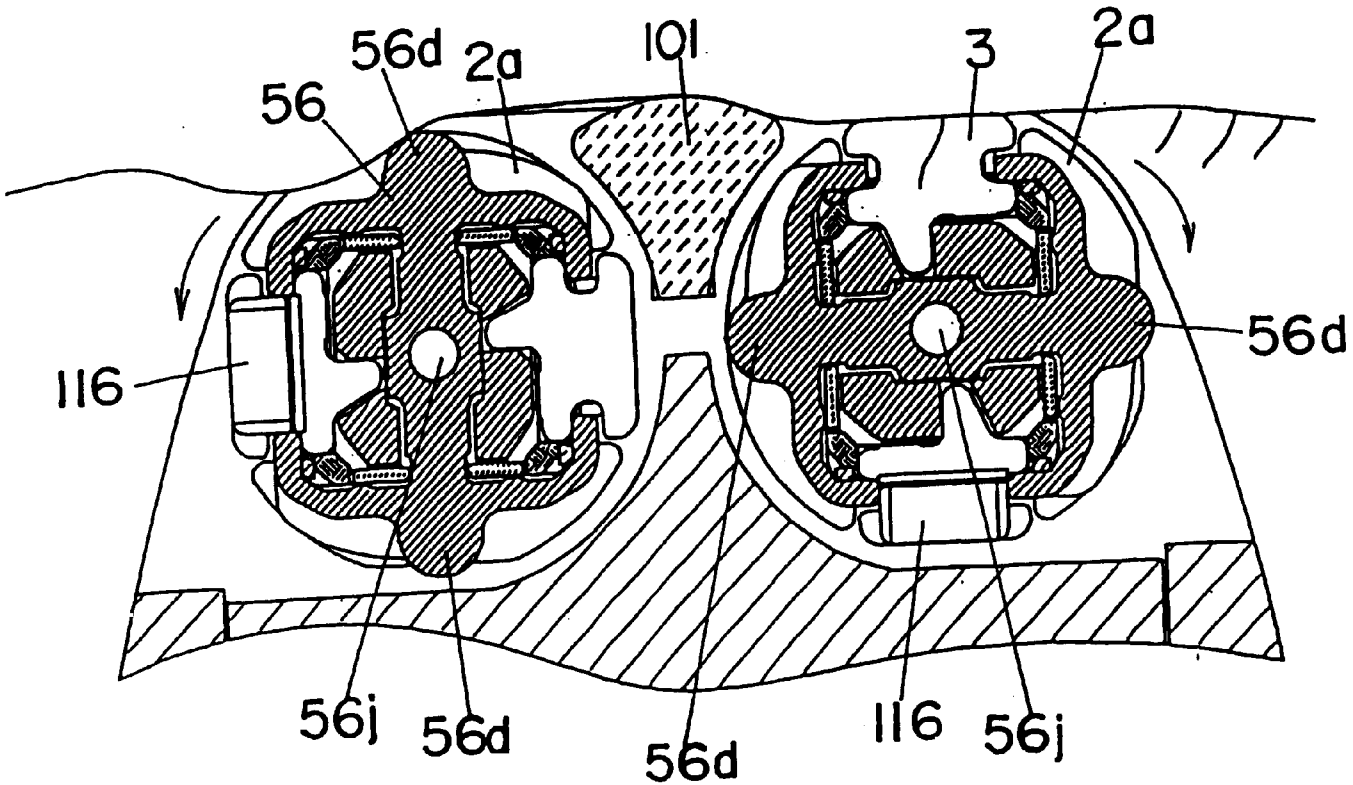
FIG. 15 is an operational view of the plucking heads according to the present invention.

Furthermore, as stated above, the central portion of the beam (118*c*) protrudes upward and serves as a fulcrum section (118*a*). This makes it possible that the length (L2) between a point of action and a fulcrum and the length (L1) between a point of force and the fulcrum satisfies the relationship of (L1)>(L2) and also possible to reduce a gripping load, so that a plucking block with improved plucking efficiency and less noise can be provided, as shown in FIG. 14.

As shown in FIG. 13, since the length (A2) of the hole (118*d*) of the blade fulcrum member 118 in longitudinal direction is slightly larger than the length (A1) of the beam (117*a*) of the fixed blade block 117, the beam (117*a*) of the fixed blade block 117 is slightly shaky with respect to the blade fulcrum ember 118. Even if there is a displacement between the beam (118*c*) of the blade fulcrum member 118 and the fixed blade 116 of the fixed blade block 117 when the movable blade 3 is closed between the fixed blades 116 of the fixed blade block 117 and the blade fulcrum member 118, the fixed blade block 117 can move in longitudinal direction to the extent corresponding to the displacement and the balance between the beam (118*c*) of the blade fulcrum member 118 and the fixed blade 116 of the fixed blade block 117 can be made. Thus, the irregularity of load can be removed when the hairs are gripped between the movable blades 3 and the fixed blade 116 of the fixed blade block 117 and hair plucking with good plucking efficiency without chances of breaking hairs can be ensured.

The blade attachment base 56 having the blade attachment gear 60 on its one end is provided with two grooves (56*a*) parallel to the rotary shaft (56*j*) circumferentially. The grooves (56*a*) are opened to circumferential surface parallel to the rotary shaft (56*j*) and to longitudinal different surface from the blade attachment gear 60 of the blade attachment base 56 (the grooves (56*a*) are opened continuously to the side opening on the end portion opposite to the blade attachment gear 60 out of the circumferential surface parallel to the rotary shaft (56*j*), and opened by forming a hole penetrating the blade attachment gear 60 at the gear 60 side), and a support section (56*c*) is provided on the opening edge portion on the circumferential surface of the groove (56*a*) in the radial direction of the blade attachment base 56. The blade block bodies 69 formed into blocks as stated above are incorporated into the two grooves (56*a*), respectively, by being fitted and slid from the side openings opposite to the blade attachment gear 60 into the grooves (56*a*). Specifically, one of the blade blocks 69 is incorporated into one of the grooves (56*a*) from the side opening at the opposite side to the blade attachment gear 60 so that longitudinal direction of the blade block 69 become same direction with that of the base 56. At this moment, the magnet 200 of the blade moving lever 67 of the blade block body 69 protrudes outward from the hole provided in the blade attachment gear 60 and the magnet 200 of the blade moving lever 68 of the blade block body 69 protrudes outward from the side opening of the groove (56*a*) at the opposite side to the blade attachment base gear 60. In addition, the other blade block body 69 is incorporated into the other groove (56*a*) from the side opening at the opposite side to the blade attachment gear 60 at the magnet 200 side of the blade moving lever 68. At this moment, the magnet 200 of the blade moving lever 68 of the other blade block body 69 protrudes outward from the hole provided in the blade attachment base gear 60 and the magnet 200 of the blade moving lever 67 thereof protrudes outward from the opening of the groove (56*a*) at the opposite side to the blade attachment base gear 60. By so incorporating, the wider beam (118*c*) out of those on the longitudinal end portions of the blade fulcrum member 118 of one blade block body 69 is positioned at the blade base attachment gear 60 side, whereas the narrower beam (118*c*) out of those on the longitudinal end portions of the blade fulcrum member 118 of the other blade block body 69 is positioned at the blade base attachment gear 60 side. As a result, in the plucking head (2*a*) thus assembled, the positions of the fixed blades 116 of one blade block body 69 and those of the fixed blades 116 of the other blade block body 69 are displaced with respect to each other in the axial direction of the rotary shaft (56*j*) of the plucking head (2*a*) (see FIGS. 2 to 4).

As described above, since the positions of the fixed blades 116 of respective blade block bodies 69 are displaced with respect to each other, body hairs at different positions can be gripped when the plucking head (2*a*) rotates once. Here, as shown in FIG. 14, to prevent the detachment of the blade block body 69, the blade fulcrum member 118 is fitted into a wider portion of the groove (56*a*) and the blade block body 69 is supported in a radial direction of the blade attachment base 56 to thereby prevent the detachment of the blade block body on a narrower portion of the groove (56*a*) in the direction orthogonal to the rotary shaft (56*j*). At this time, the protruding portion (3*b*) of the movable blade 3 is fitted into the wider portion of the groove (56*a*) to thereby prevent the detachment of the protruding portion (3*b*) of the movable blade 3 on the narrower portion of the groove (56*a*) in the direction orthogonal to the rotary shaft (56*j*). Additionally, tip end portions of the fixed blades 116 and those of the movable blades 3 constituting the hair grip member of the blade block body 69 protrude outward from the opening of the groove (56*a*) on the circumferential surface of the blade attachment base 56. This facilitates gripping hairs between the fixed blade 116 of the fixed blade block 117 and the movable blade 3.

In this case, a projecting portion (56*d*) is provided between the blade block bodies 69 on the circumferential surface of the blade attachment base 56 to stretch the skin in the rotary direction. The projecting portion (56*d*) is set to have the same diameter as those of the longitudinal end portions of the blade attachment base 56 or to slightly protrude therefrom. When two plucking heads (2*a*) are provided on front and back portions in parallel to rotary shaft (56*j*) with respect to the housing 10, respectively, so as to rotate in different directions, respectively, front and back plucking heads (2*a*) are displaced with respect to each other by 90° to have different hair plucking timing. That is, when the front plucking head (2*a*) is at a position at which the head (2*a*) grips the hair, the projecting portion (56*d*) of the back plucking head (2*a*) is positioned on a skin surface. Accordingly, when one of the plucking heads (2*a*) grips the body hairs, the other plucking head (2*a*) stretches the skin surface in rotary direction. The operations of the front and back plucking heads (2*a*) are carried out alternately. Besides, since the respective plucking heads (2*a*) can grip hairs at different positions during the half-rotation of the heads (2*a*), it is possible to realize efficient hair plucking (FIG. 15), to reduce a gripping load by 1/(the number of plucking heads)× (the number of blade block bodies) and to reduce stimulus to the skin as well as noise. Here, if the diameter of the plucking head (2*a*) (or the diameter of the blade attachment base 56) is set at 7 to 13 mm, a plurality of heads (2*a*) can be arranged adjacent one another and can be made smaller in size, thereby improving convenience.

Furthermore, all of the blade block bodies 69 are not fitted into several grooves of the blade attachment base 56 in the same direction but alternately. Namely, in the blade fulcrum member 118 into which the fixed blade block 117 is incorporated, the beams (118*c*) and the openings (118*b*) are arranged in an asymmetric manner in the longitudinal direction of the member 118 and deviated toward either side in the longitudinal direction. For that reason, by fitting the blade block bodies 69 into the grooves alternately, the plucking head (2*a*) can grip hairs between the movable blades 3 and the fixed blade 116 of the fixed blade block 117 at each of different positions when the head (2*a*) rotates once.

Moreover, to prevent the detachment of the blade block body 69 in longitudinal direction (parallel to the rotary shaft (56*j*), end portion of the blade fulcrum member 118 of the blade block body 69 abuts against an abutment portion (56*e*) provided on one end of the blade attachment base 56. In this state, on the other end portion of the base 56, a protruding portion 115*a* of the cover 115 is fitted into the groove (56*a*) of the blade attachment base 56 and covers a part of the side opening of the blade fulcrum member 118. It is noted that to prevent the detachment of the cover 115, bosses (56*b*) provided on the blade attachment base 56 are inserted into holes (115*b*) provided in the cover 115, respectively, and the bosses (56*b*) protruding from the side surface of the cover 115 are sealed.

Side stoppers 506 are provided on the side surfaces of the both axial ends of the plucking head (2*a*), respectively between the blade moving levers 67 and 68 provided axially movably, in the rotation direction of the plucking head (2*a*). In this embodiment, the side stoppers 506 are provided between the blade moving levers 67 and 68 on the side surface of the blade attachment gear 60 and the side surface of the cover 115, respectively, which side surfaces constitute those on the both ends of the plucking head (2*a*), in the rotary direction of the head (2*a*).

Bosses (56*f*) are provided on both axial ends of the blade attachment base 56, respectively. The bosses (56*f*) are arranged to adjacently face bosses 505 provided on the bases (55L) and (55R), respectively, with small gaps therebetween when the plucking head (2*a*) is incorporated into the bases (55L) and (55R) and pivotally supported by the shaft (56*j*). This prevents the plucking head (2*a*) from moving in axial direction and being greatly displaced. To this end, the bosses (56*f*) are provided on both axial ends of the plucking head (2*a*) to thereby constitute stoppers for preventing the plucking head (2*a*) from being deviated in axial direction.

The movable blades 3 swing by means of magnets 201 and 202 symmetrically disposed at upper and lower positions, respectively with respect to the shaft (56*j*) of the bases (55L) and (55R), as well as by the magnets 200 provided on the end portions of the blade moving levers 67 and 68. The magnets 201 provided upward of the shaft (56*j*) of the bases (55L) and (55R) (i.e., at the opening side of the head frame 5) have the same polarity as that of the magnets 200 provided on the end portions of the blade moving levers 67 and 68. The magnets 202 provided downward of the shaft (56*j*) of the bases (55L) and (55R) (i.e., at the opposite side to the opening of the head frame 5) have a different polarity from that of the magnets 200 provided on the end portions of the blade moving levers 67 and 68.

Figure 3:
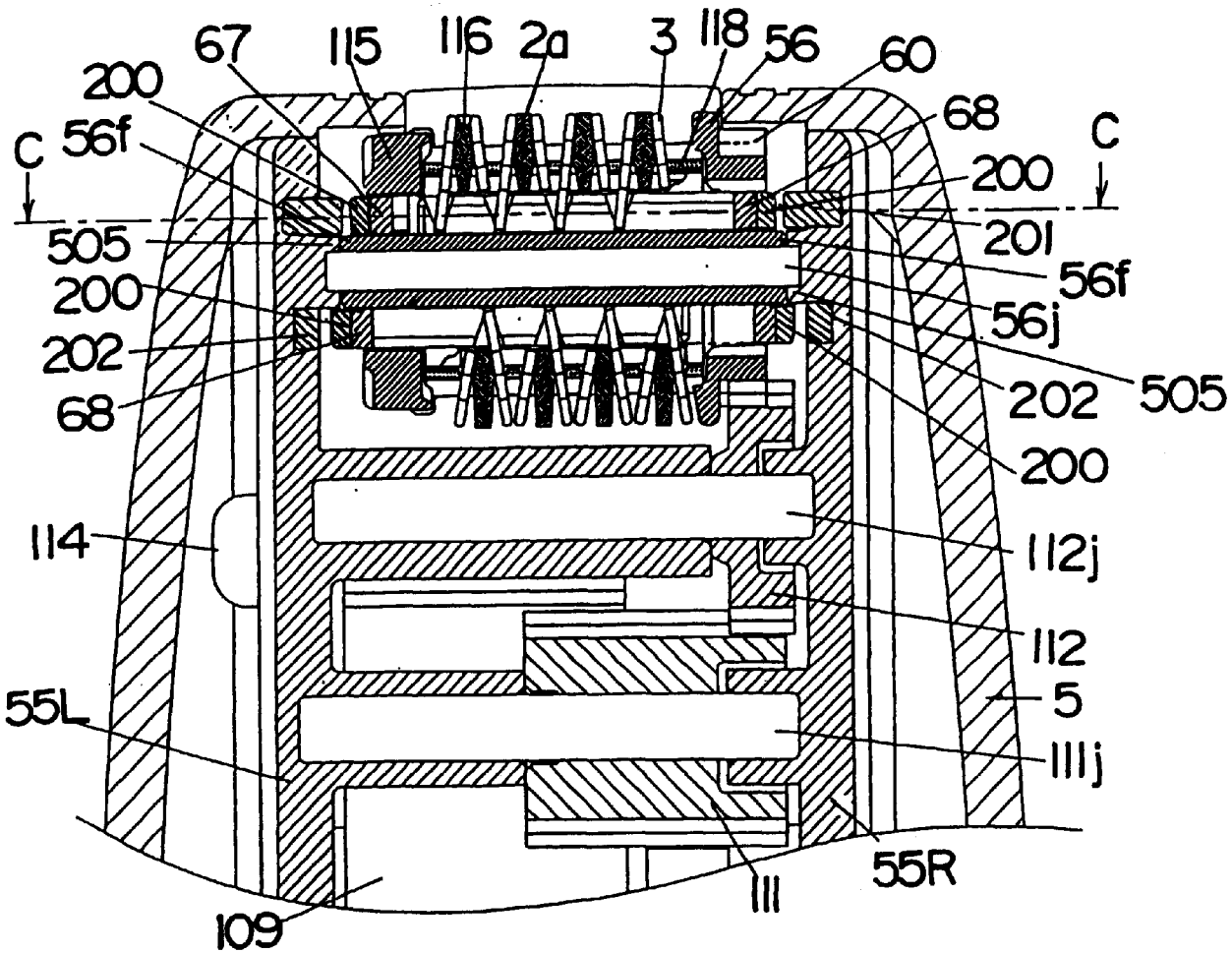
FIG. 3 is an enlarged front sectional view according to the present invention.
Figure 4:
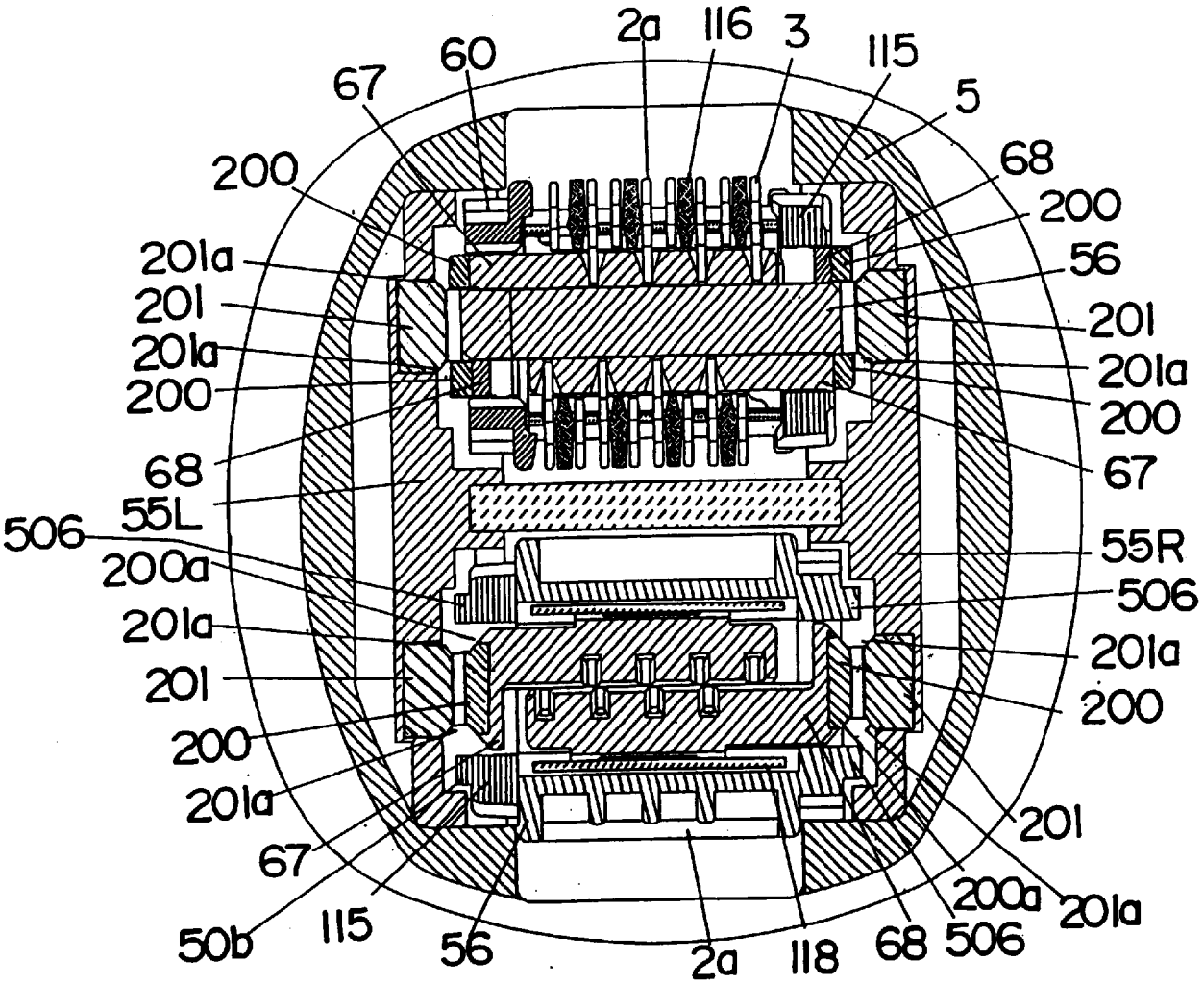
FIG. 4 is a cross-sectional view taken along line C—C of FIG. 3 according to the present invention.
Figure 5:
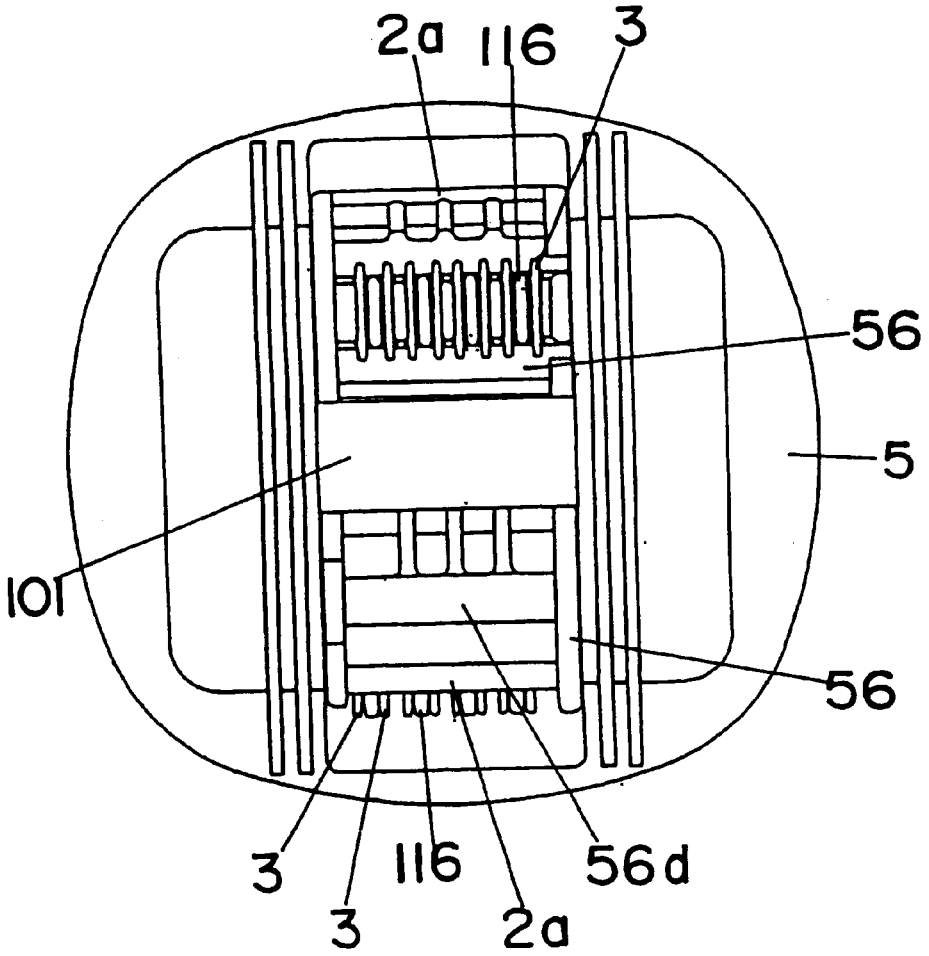
FIG. 5 is a plan view according to the present invention.
Figure 11A:
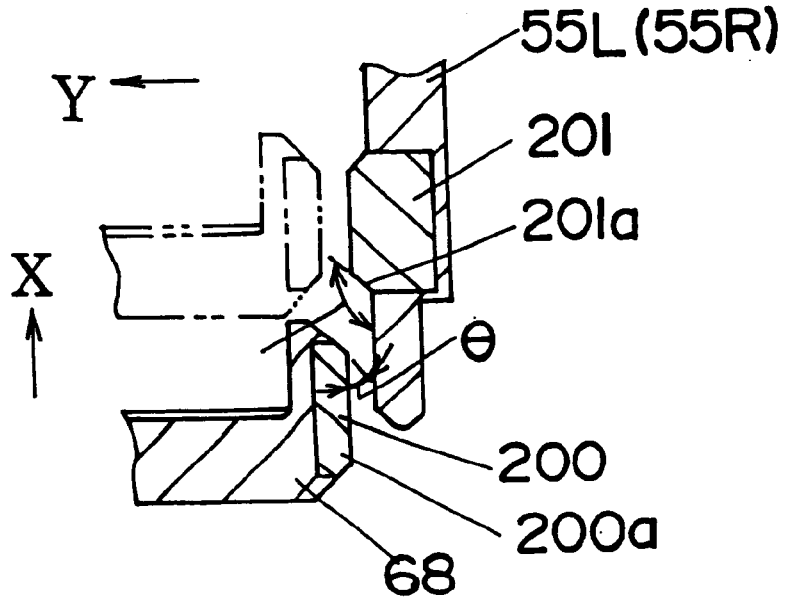
FIG. 11(*a*) is a cross-sectional view for describing an example in which the end portion of a magnet provided on the end portion of a blade moving lever and that of a magnet provided on a base in rotation direction are provided with inclined surfaces to make magnetic flux directions inclined toward axial direction, respectively.
Figure 11B:
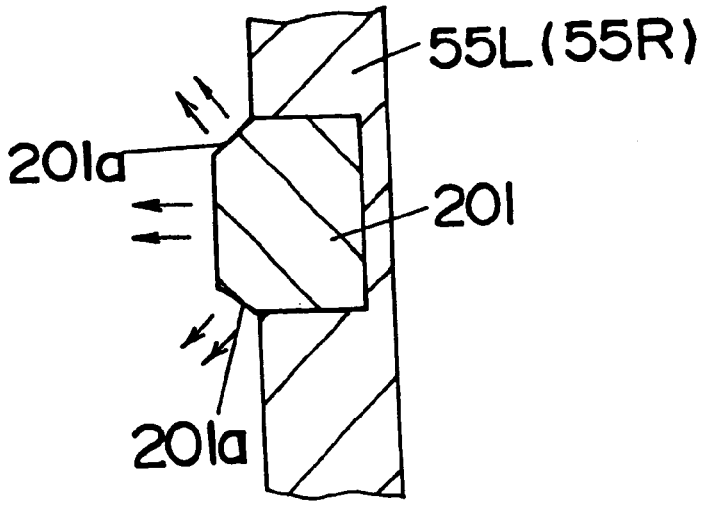
Figure 12:
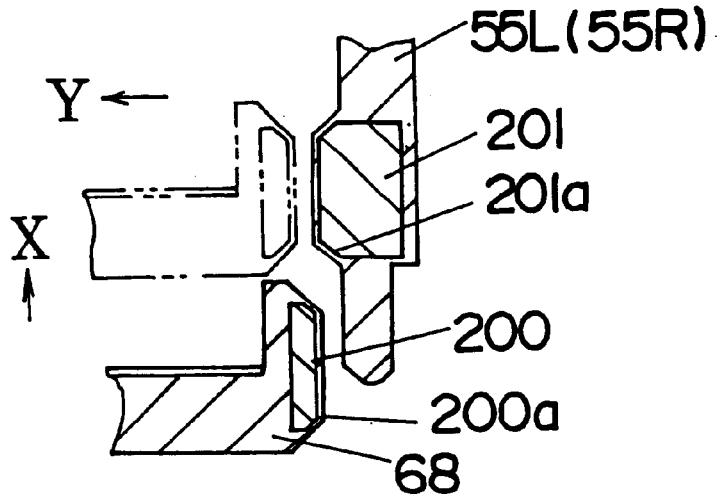
FIG. 12 is a cross-sectional view showing an example of covering the magnets with a forming material.

The opening/closing operations of the blade moving levers 67 and 68 are carried out as follows. As shown in FIG. 3, when the magnets 200 provided integrally with the blade moving levers 67 and 68 of one of the blade block bodies 69 are closer to the magnets 201 having the same polarity as that of the magnets 200, the magnets 200 and 201 repel each other and slide inside, thereby swinging the movable blades 3. At this moment, as shown in FIGS. 4 and 11, the end portions (200*a*) or (201*a*) of at least either the magnets 200 provided on the blade moving levers 67 and 68 or the magnets 201 provided on the bases (55L) and (55R) in the rotary direction are given an angle (θ) as shown in FIG. 11(*a*), whereby the direction of magnetic fluxes of the magnets are set different from the axial direction, that is, set in a repulsive direction when the blade moving levers 67 and 68 are closer to the magnets 201. By doing so, even at high-speed rotation, the magnets 200 of the blade moving levers 67 and 68 ride on the magnets 201 of the bases (55L) and (55R) and the noise of the plucking head (2*a*) can be, therefore, reduced. Arrows in FIG. 11(*b*) indicate the directions of the magnetic fluxes. In FIGS. 11(*a*) and 12, an arrow (X) indicates the rotary direction of the blade moving lever and an arrow (Y) indicates the direction in which the blade moving lever moves inside after the magnets 200 and 201 repel each other. Here, even if loads are applied to the blade moving levers 67 and 68 in the rotation direction thereof due to repulsion or attraction, it is possible to restrict bending loads generated on the blade moving levers 67 and 68. Also, even if many blade moving levers 67 and 68 are arranged adjacent one another in the rotary direction thereof and receive repulsion or attraction forces by the magnets 200 provided on adjacent blade moving levers 67 and 68, it is possible to restrict bending loads generated on the blade moving levers 67 and 68. It is, therefore, possible to move smoothly the blade moving levers 67 and 68 in axial direction and to thereby reduce the noise of the plucking head (2*a*). In this way, since the blade moving levers are in non-contact with each other due to the presence of the magnets, noise generated when directly sliding the levers by means of conventional cams is removed, thereby making it possible to provide an epilating device with less noise.

Next, when the plucking head (2*a*) rotates and the blade moving levers 67 and 68 are closer to the magnets 202 by turning to the opposite side to the opening of the head frame 5 with respect to the shaft (56*j*), the magnets 200 provided on the blade moving levers 67 and 68 and the magnets 202 pull each other and the blade moving levers 67 and 68 slide outside to thereby open the movable blades 3. At this moment, the outside sliding of the blade moving levers 67 and 68 is restricted not to exceed a certain degree by abutting the hooks (67*b*) and (68*b*) against the ribs (118*e*) provided on the blade fulcrum member 118. By doing so, the opening/closing operations of the blade moving levers 67 and 68 can be carried out with a simple configuration and good assembly efficiency can be ensured. At this time, as shown in FIGS. 3, 4 and 7 to 12, the magnets 200 of the blade moving levers 67 and 68 and the magnets 201 and 202 of the bases (55L) and (55R) are formed integrally with their respective members and magnet portions are covered with a forming material made of synthetic resin for forming the members, whereby foreign matters adhering to the magnets during assembly process can be easily removed from the magnets and assembly efficiency can be improved. Even if the magnets 200, 201 and 202 provided on the blade moving levers 67, 68 and the bases (55L) and (55R) have different magnetic forces and the plucking head (2*a*) is deviated to either side, the bosses (56*f*) provided on the both axial ends of the blade attachment base 56 act as stoppers in axial direction and the deviation is restricted between the bosses 505 provided on the bases (55L) and (55R). Thus, the magnets do not abut against one another and a driving sound can be thereby softened.

Figure 8:
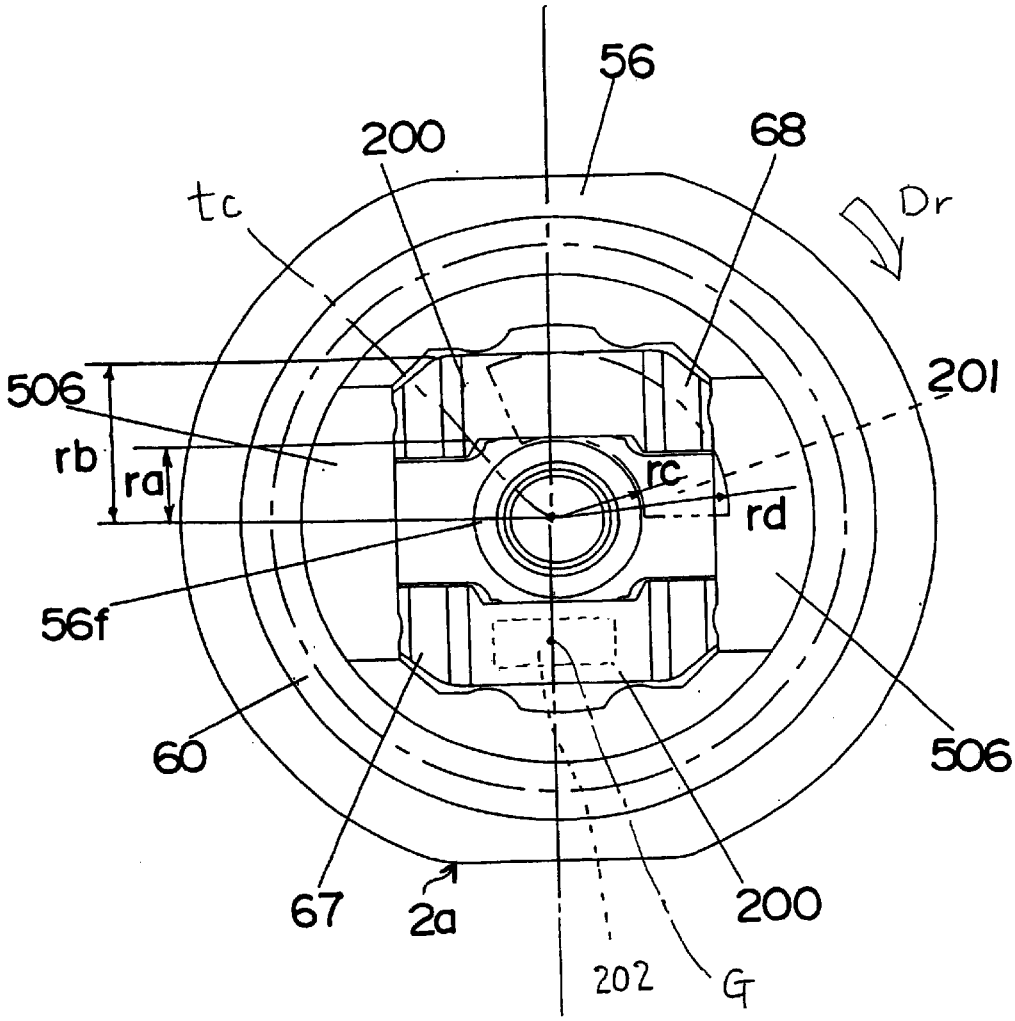
FIG. 8 is a side view of the plucking head according to the present invention.

Furthermore, since the movable blades 3 swing as already stated above, forces applied to the blade moving levers 67 and 68 can be reduced. It is, therefore, possible to reduce the magnetic forces of the magnets 200 of the blade moving levers 67 and 68 and the magnets 201 and 202 provided on the bases (55L) and (55R), and to make a drive section constituting the blade moving means smaller in size. Here, as shown in FIG. 8, it is assumed that a length from the rotation center of the plucking head (2*a*) to the inner end of each of the magnets 200 of the blade moving levers 67 and 68 (i.e., the inside diameter in radial direction with respect to the rotation of the head) is (ra) , a length from the rotation center to the outer end of each magnet 200 (i.e., the outside diameter in radial direction with respect to the rotation) is (rb), a length from the rotation center to the inner end of each of the magnets 201 provided on the bases (55L) and (55R) (i.e., the inside diameter in radial direction with respect to the rotation) is (rc) and a length from the rotation center to the outer end of the magnet 201 (i.e., the outside diameter in radial direction with respect to the rotation) is (rd) and these lengths are set to satisfy relationships of (ra)=(rc) and (rb)=(rd). By constituting the magnets 200 provided on the end portions of the blade moving levers 67 and 68 and the magnets 201 arranged at positions corresponding to the magnets 200 such that the magnets 201 and 200 have the same outside diameter and the same inside diameter in radial direction with respect to the rotation, the end portions having stable magnetic fluxes are put at the same positions. As a result, not only the thicknesses of the magnets can be reduced but also stable magnetic forces can be obtained. Accordingly, the plucking blade can obtain a stable gripping force and good hair plucking efficiency can be provided without chances of breaking hairs or leaving several hairs unplucked. The above embodiment has been described while taking the relationship between the magnets 200 and 201 as an example. It is also preferable that the magnets 200 and 202 have the same relationship as that of the magnets 200 and 201. As shown in FIG. 8, the first fixed magnet 201 is arranged to shift along a rotational direction (Dr) of the plucking head (2*a*) from a line (L) connecting the center axis (XC) of the plucking head (2*a*) and a center (G) of the second fixed magnet 202.

Figure 16:
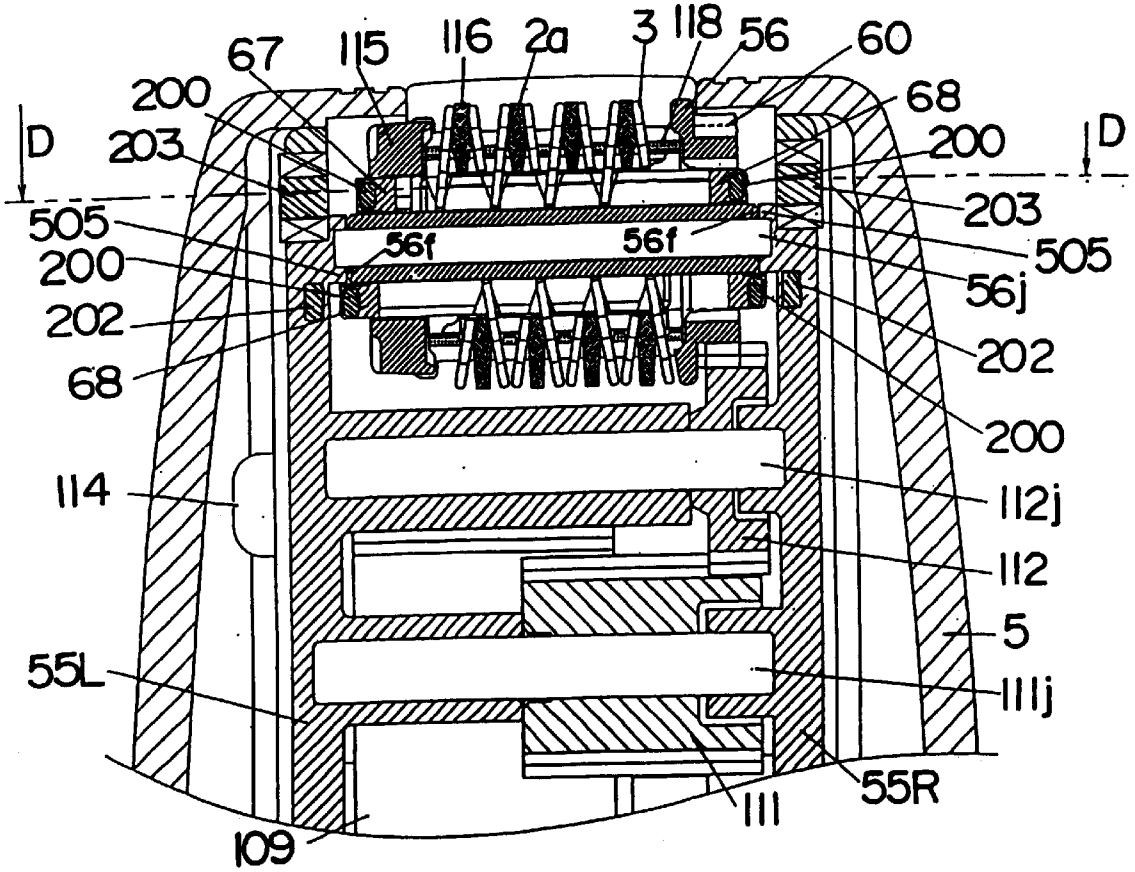
FIG. 16 is an enlarged front sectional view of another embodiment according to the present invention.
Figure 17:
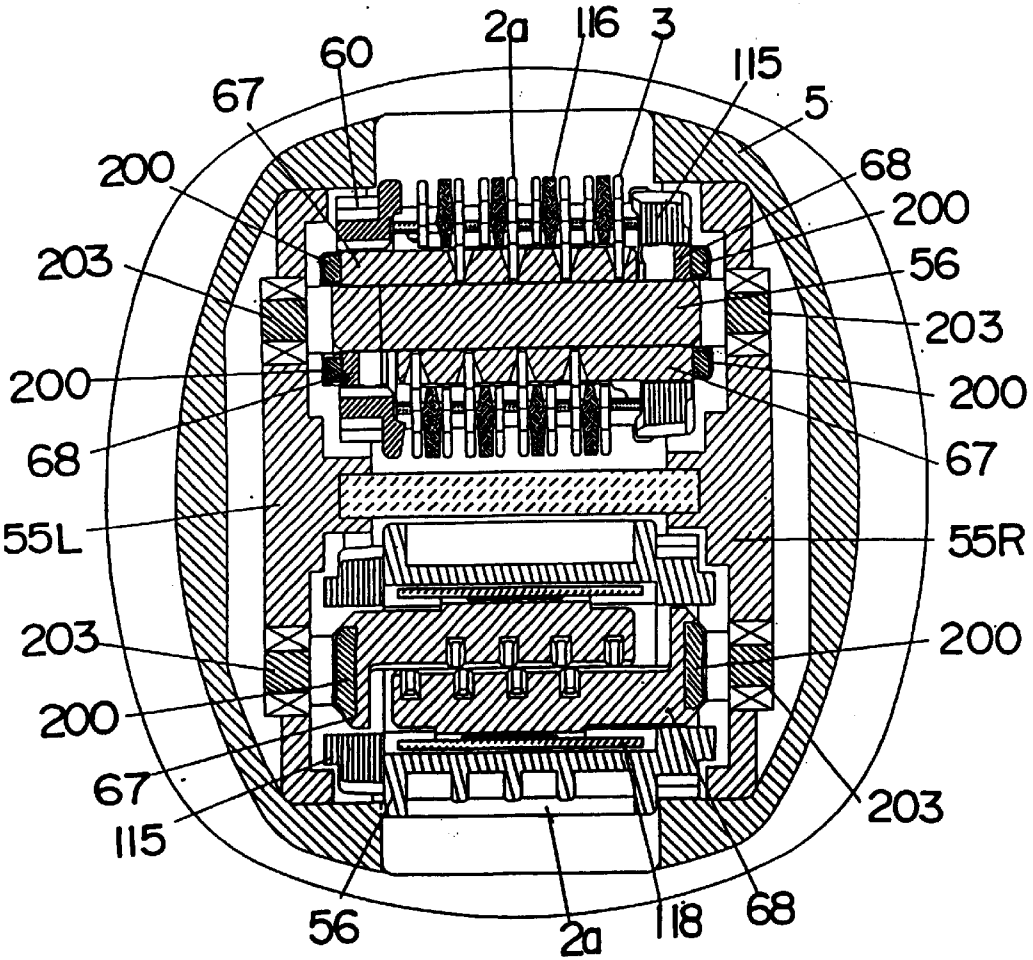
FIG. 17 is a cross-sectional view taken along line D—D of FIG. 16 according to the present invention.

FIGS. 16 and 17 show another embodiment according to the present invention. This embodiment illustrates that the opening/closing operations of the blade moving levers 67 and 68 are carried out by electromagnets 203 and the magnets 202. In particular, by providing the electromagnets 203 at the side at which movable blades 3 are closed (opening side of the head frame 5), a force for sliding the blade moving levers 67 and 68 inside can be increased. Besides, even if the number of movable blades 3 is large, a holding strength for holding hairs can be increased and efficient hair plucking can be ensured with less driving sound and without chances of breaking hairs and leaving several hairs unplucked.

Figure 18:
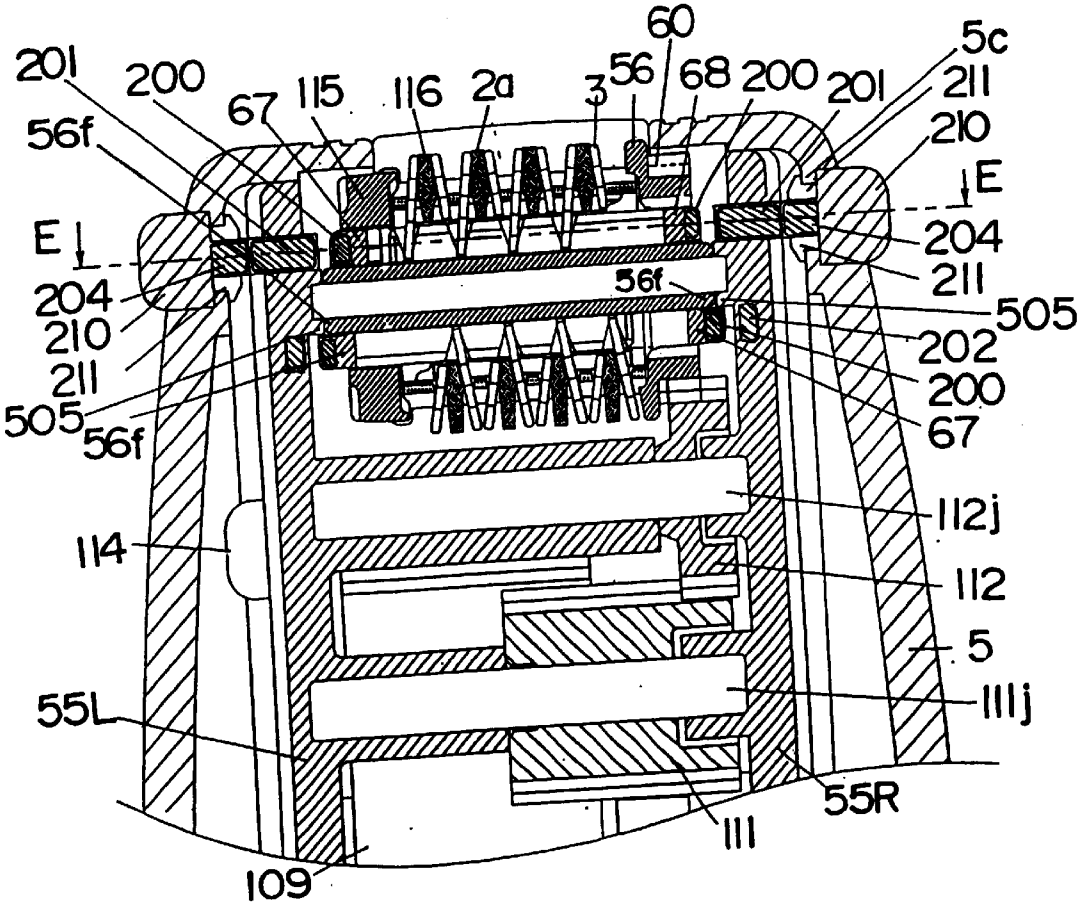
FIG. 18 is an enlarged front sectional view of yet another embodiment according to the present invention.
Figure 19:
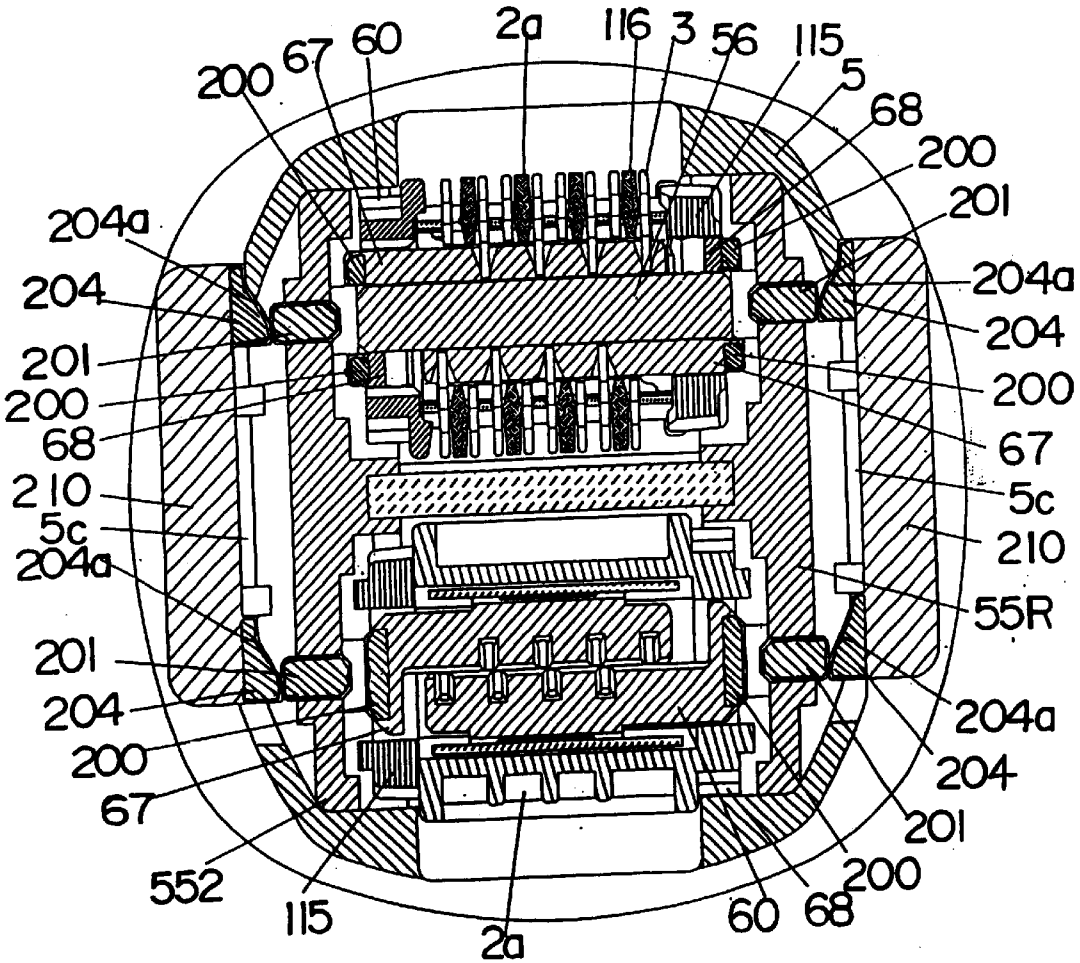
FIG. 19 is a cross-sectional view taken along line E—E of FIG. 18 according to the present invention.

FIGS. 18 and 19 show yet another embodiment according to the present invention. In this embodiment, slide handles 210 are provided on both ends of the head frame 5 in the direction of the shaft (56*j*). The slide handles 210 are attached such that hooks 211 integral with the handles 210 are slidably fitted into holes 5*c* provided in the head frame 5 and elongated in a direction orthogonal to the shaft (56*j*) and that tip end portions of the hooks 211 are stopped at inner edges of the holes (5*c*), respectably, to prevent the detachment of the slide handles 210. Magnets 204 are provided at the plucking head (2*a*) side of the slide handles 210, respectively. Also, holes are formed in the bases (55L) and (55R), into which holes magnets 201 are installed movably in the direction of the shaft (56*j*). The magnets 204 provided on the slide handles 210 are set to have a different polarity from that of the magnets 201 provided on the bases (55L) and (55R) movably in the direction of the shaft (56*j*). Therefore, as shown in FIG. 19, the surfaces of the magnets 204 provided integrally with the slide handles 210 which surfaces face the magnets 201, respectively, are formed as steps having inclined surfaces (204*a*) inclined in sliding directions, respectively. When the slide handles 210 slide, the magnets 201 provided on the bases (55L) and (55R) slide by the steps provided on the magnets 204 of the slide handles 210 in the direction of the shaft (56*j*), respectively. By changing the lengths between the magnets 201 provided on the bases (55L) and (55R) and the magnets 200 provided on the blade moving levers 67 and 68, magnetic forces applied to the magnets 200 provided on the blade moving levers 67 and 68 can be changed accordingly. The holding strength of the movable blades 3 for holding hairs is made variable such that magnetic forces are increased for leg hairs requiring a relatively large plucking force and that magnetic forces are reduced for arm hairs and the like which do not require a plucking force larger than that for the leg hairs. It is thereby possible to provide an epilating device having good plucking efficiency and with quiet sound.

In the above-stated embodiments, a series of plucking blades are provided on both sides across the rotation center. Three or more series of plucking blades may be arranged around the rotation center.

It is noted that a reference number 101 denotes a skin pressing member arranged between the front and back plucking blocks (2*a*) in the upper opening of the head frame 5.

The movable blades 3 are configured to oscillate to grip and release hairs. Although the movable blades 3 are configured to swing in the embodiments, the movable blades may be configured to be reciprocally and linearly moved. In this case, if the fixed and movable blades are in parallel with each other, hairs are gripped between the surfaces of the fixed and movable blades. On the other hand, if the fixed and movable blades are not in parallel with each other, hairs are gripped at the contacting lines of the fixed and movable blades which contact each other. When the movable blades 3 are configured to swing as explained in the embodiments, hairs are gripped at the contacting lines of the fixed and movable blades which contact each other.

Although the plucking heads (2*a*) pluck the hairs by their rotational movement in the embodiments, the plucking heads (2*a*) may pluck the hairs by other movements.

The first and second plucking heads (2*a*) may be configured to rotate in the same direction.

Although the first and second plucking heads (2*a*) pluck hairs at different timings in the above-described embodiment, a plurality of the plucking heads (2*a*) may pluck hairs at the same time.

Although the movable blades 3 close to grip hairs when the movable magnets 200 face the first fixed magnet 201 which has the same polarity as the polarity of the movable magnets 200, the movable blades 3 may close when the movable magnets 200 face the fixed magnet which has polarity different from the polarity of the movable magnets 200.

Further, although each plucking head (2*a*) includes two blade block bodies 69 in the above embodiments, the plucking heads (2*a*) may include different number of blade block bodies 69. For example, one plucking head (2*a*) includes one blade block body 69, while another plucking head (2*a*) does not include a blade block body 69. One plucking head (2*a*) may includes two blade block bodies 69, while another plucking head (2*a*) includes three blade block bodies 69.

Obviously, numerous modifications and variations of the present invention are possible in light of the above teachings. It is therefore to be understood that, within the scope of the appended claims, the invention may be practiced otherwise than as specifically described herein.

What is claimed as new and is desired to be secured by Letters Patent of the United States is:

1. An epilating device comprising:

a plurality of blades configured to pluck hairs and including at least one movable blade which is configured to oscillate to grip and release the hairs;

a blade moving member configured to be reciprocally and substantially linearly moved to oscillate the at least one movable blade; and an actuator configured to move the blade moving member reciprocally and substantially linearly without contacting the blade moving member.

2. The epilating device according to claim 1, wherein the at least one movable blade is arranged to be swingable to grip and release the hairs.

3. The epilating device according to claim 1, wherein the plurality of blades are configured to rotate to pluck the hairs.

4. The epilating device according to claim 1, further comprising:

at least one plucking head including at least one blade block body which has the plurality of blades and the blade moving member, the at least one plucking head being configured to rotate around a center axis of the at least one plucking head such that the at least one movable blade swings to grip the hairs and such that the plurality of blades rotate around the center axis of the at least one plucking head to pluck the hairs, the blade moving member being configured to be moved reciprocally and substantially along the center axis.

5. The epilating device according to claim 4, wherein the at least one plucking head comprises first and second plucking heads which are configured to rotate in opposite directions.

6. The epilating device according to claim 5, wherein the first and second plucking heads pluck the hairs at different timings.

7. The epilating device according to claim 6, wherein the first and second plucking heads comprise first and second blade block bodies, respectively, and the first and second plucking heads alternately pluck the hairs every 90 degree rotation.

8. The epilating device according to claim 6, wherein each of the first and second plucking heads comprises at least one projecting portion, the at least one projecting portion of the first plucking head being configured to contact skin when the second plucking head plucks the hairs, the at least one projecting portion of the second plucking head being configured to contact the skin when the first plucking head plucks the hairs.

9. The epilating device according to claim 4, wherein the at least one blade block body comprises first and second blade block bodies which are arranged along the center axis and substantially symmetrically with respect to the center axis.

10. The epilating device according to claim 4, wherein the at least one blade block body comprises first and second blade block bodies which are arranged substantially along the center axis to be relatively shifted each other along the center axis.

11. The epilating device according to claim 4, wherein the at least one blade block body comprises a blade fulcrum member with respect to which the at least one movable blade is swingable to grip and release the hairs, the blade fulcrum member being made of metal.

12. The epilating device according to claim 4, wherein the at least one blade block body comprises a blade fulcrum member including at least one opening and at least one beam at an edge of the at least one opening, and wherein the plurality of blades comprise at least one fixed blade which is inserted in the at least one opening together with the at least one movable blade such that the at least one movable blade is swingable around a swinging center between a closing position at which the hairs are gripped between the at least one fixed blade and the at least one movable blade and an opening position at which the at least one movable blade is fully opened, and a closing angle formed between the at least one movable blade and a plane which is parallel with the at least one fixed blade and which passes the swinging center when the at least one movable blade is in the closing position is smaller than an opening angle formed between the at least one movable blade and the plane when the at least one movable blade is in the opening position.

13. The epilating device according to claim 4, wherein the at least one movable blade is arranged to be swingable around a swinging center to grip and release the hairs, a first distance between the swinging center and a hair grabbing portion of the at least one movable blade being smaller than a second distance between the swinging center and an operated portion of the at least one movable blade which is engaged with the blade moving member.

14. The epilating device according to claim 1, wherein the actuator utilizes magnetic force to move the blade moving member reciprocally and substantially linearly without contacting the blade moving member.

15. The epilating device according to claim 4, wherein the actuator comprises at least one movable magnet which is provided to the blade moving member; and first and second fixed magnets which are provided along a rotational locus of the at least one movable magnet.

16. The epilating device according to claim 15, wherein the first fixed magnet has same polarity as polarity of the at least one movable magnet, and wherein the second fixed magnet has polarity different from the polarity of the at least one movable magnet.

17. The epilating device according to claim 16, wherein the first and second fixed magnets are arranged such that centers of the first and second fixed magnets are 180 degrees apart along the rotational locus of the at least one movable magnet.

18. The epilating device according to claim 16, wherein the at least one movable blade closes to grip hairs when the at least one movable magnet faces the first fixed magnet, and wherein the at least one movable blade opens when the at least one movable magnet faces the second fixed magnet.

19. The epilating device according to claim 18, wherein the first fixed magnet is arranged to shift along a rotational direction of the at least one plucking head from a line connecting the center axis and a center of the second fixed magnet.

20. The epilating device according to claim 15, wherein first and/or second magnets comprise electromagnets.

21. The epilating device according to claim 15, wherein first and/or second magnets comprise permanent magnets.

22. The epilating device according to claim 15, wherein the at least one plucking head comprises at least one side stopper provided on a side surface of the at least one plucking head to prevent a movement of the blade moving member in a direction substantially perpendicular to the center axis.

23. The epilating device according to claim 15, wherein the at least one movable magnet is embedded in the blade moving member, and wherein the first and second fixed magnets are embedded in a casing of the epilating device.

24. The epilating device according to claim 16, wherein the first fixed magnet has a fixed periphery on a side facing the at least one movable magnet, the movable magnet has a movable periphery on a side facing the first fixed magnet, and at least one of the fixed and movable peripheries are inclined.

25. The epilating device according to claim 16, wherein a length from the center axis of the at least one plucking head to an inner periphery of the movable magnet is equal to a length from the center axis to an inner periphery of the first fixed magnet, and wherein a length from the center axis to an outer periphery of the movable magnet is equal to a length from the center axis to an outer periphery of the first fixed magnet.

26. The epilating device according to claim 14, wherein the magnetic force is variable.

27. The epilating device according to claim 1, wherein the plurality of blades comprise at least one fixed blade, and the hairs are gripped between the at least one fixed blade and the at least one movable blade.

28. An epilating device comprising:

a plurality of blades configured to pluck hairs and including at least one movable blade which is configured to oscillate to grip and release the hairs;

blade moving means for oscillating the at least one movable blade, the blade moving means being reciprocally and substantially linearly moved to oscillate the at least one movable blade; and actuator means for moving the blade moving means reciprocally and substantially linearly without contacting the blade moving means.

* * * * *